US009809353B2

(12) United States Patent
Gieske et al.

(10) Patent No.: US 9,809,353 B2
(45) Date of Patent: Nov. 7, 2017

(54) DISPENSING CONTAINER FOR LIQUIDS

(71) Applicant: McCormick & Company, Incorporated, Sparks, MD (US)

(72) Inventors: Thomas Koll Porter Gieske, Lutherville, MD (US); David A. Rainey, Fallston, MD (US); Donald H. Ankney, Lexington, KY (US)

(73) Assignee: MCCORMICK & COMPANY, INCORPORATED, Sparks, MD (US)

( * ) Notice: Subject to any disclaimer, the term of this patent is extended or adjusted under 35 U.S.C. 154(b) by 0 days.

(21) Appl. No.: 14/212,956

(22) Filed: Mar. 14, 2014

(65) Prior Publication Data

US 2014/0263383 A1 Sep. 18, 2014

Related U.S. Application Data

(60) Provisional application No. 61/800,297, filed on Mar. 15, 2013.

(51) Int. Cl.
*A47G 19/00* (2006.01)
*B65D 25/10* (2006.01)
(Continued)

(52) U.S. Cl.
CPC ..... *B65D 25/2894* (2013.01); *B65D 21/0212* (2013.01); *B65D 23/10* (2013.01); *B65D 25/28* (2013.01)

(58) Field of Classification Search
CPC ..... B65D 2501/24401; B65D 2501/24522; B65D 2501/24509; B65D 25/28; B65D 25/2802; B65D 25/2826; B65D 25/2894; B65D 25/2882; B65D 25/2858; B65D 2525/281; B65D 21/0212; B65D 23/10; B65D 23/102; B65D 23/106; B65D 1/20
(Continued)

(56) References Cited

U.S. PATENT DOCUMENTS 2,726,795 A 12/1955 Billock et al.
3,400,846 A * 9/1968 Kelly ..... 215/398
(Continued)

OTHER PUBLICATIONS

Mexican Office Action dated May 2, 2016 and issued in Mexican Application No. MX/a/2014/003275.
(Continued)

*Primary Examiner* — Andrew T Kirsch
(74) *Attorney, Agent, or Firm* — Greenblum & Bernstein, P.L.C.

(57) ABSTRACT

A container for storing and dispensing liquids, with at least one stacking feature, a dispenser to dispense liquid contained in the container, a handle for carrying the container, an angle (γ) which is the angle between a line (DD') perpendicular to a reference lifting plane (Lp) cutting through the handle and a line parallel to a vertical of the container in a filling orientation, and a tilt angle (B) which is the angle between the line (DD') and a line going through a location of a center of gravity of the filled container in the direction of a weight force of the container. When the container is in a filling orientation the tilt angle (B) and the angle (γ) coincide, while when the container is lifted perpendicular to the lifting plane (Lp), the tilt angle (B) is substantially zero.

20 Claims, 33 Drawing Sheets

(51) Int. Cl.

| | |
|---|---|
| ***B65D 53/00*** | (2006.01) |
| ***B65D 81/24*** | (2006.01) |
| ***B65D 23/10*** | (2006.01) |
| ***B65D 1/20*** | (2006.01) |
| ***B65D 25/28*** | (2006.01) |
| ***B65D 21/02*** | (2006.01) |

(58) Field of Classification Search
USPC ..... 220/752, 753, 771, 23.6, 759, 766, 768; 215/396
See application file for complete search history.

(56) References Cited

U.S. PATENT DOCUMENTS

| | | | | |
|---|---|---|---|---|
| 4,957,209 | A * | 9/1990 | Helin | B65D 1/0223 206/503 |
| 5,131,572 | A | 7/1992 | Spengler | |
| 5,207,338 | A * | 5/1993 | Sandhu | A61J 9/00 215/11.1 |
| D341,514 | S | 11/1993 | McGinnis | |
| 5,485,920 | A | 1/1996 | Fritz | |
| D370,379 | S | 6/1996 | Klein et al. | |
| 5,922,308 | A * | 7/1999 | Brewster et al. | 424/65 |
| 6,050,455 | A | 4/2000 | Soehnlen et al. | |
| 6,196,403 | B1 * | 3/2001 | Yamaguchi | B65D 23/104 215/396 |
| D478,009 | S | 8/2003 | Kleckauskas et al. | |
| 6,631,744 | B1 | 10/2003 | Gerhart et al. | |
| 6,935,533 | B2 | 8/2005 | Clausen et al. | |
| 7,168,582 | B2 | 1/2007 | Darr et al. | |
| 7,182,214 | B2 | 2/2007 | Darr et al. | |
| D587,955 | S | 3/2009 | Stamper | |
| 7,874,443 | B2 | 1/2011 | Schutz | |
| 2005/0051575 | A1 * | 3/2005 | Durivage | 222/143 |
| 2006/0037929 | A1 | 2/2006 | Darr et al. | |
| 2007/0246488 | A1 | 10/2007 | Cash et al. | |
| 2008/0073317 | A1 * | 3/2008 | Dygert et al. | 215/397 |

OTHER PUBLICATIONS

Mexican Office Action dated Nov. 7, 2016 and issued in Mexican Application No. MX/a/2014/003275.

* cited by examiner

ALTERNATE STACKING ORIENTATION

STACKED
BOX ORIENTATION

STACKED
BOX ORIENTATION

DISPENSING CONTAINER FOR LIQUIDS

CROSS-REFERENCE TO RELATED APPLICATIONS

This application claims priority to U.S. Application No. 61/800,297, filed on Mar. 15, 2013, the entire content of which is incorporated in the present document by reference.

BACKGROUND

The description herein relates to a container for dispensing liquids.

In fast paced industries such as the food industry, there is a high turnover of supplies, as retailers go through large quantities of product, and frequently have to replenish their stocks, requiring them to unload supply trucks, and to transfer the product to their shelves, in the most efficient manner possible, wasting no time or energy in these operations.

Containers are typically packaged in groups of four for transport on freight trucks, and must later be unpacked and transported by hand. A typical 1 gallon container weighs on average over 8 pounds when full, and unloading is a strenuous task.

At the retailers, such as in restaurant kitchens, chefs need to have various ingredients readily available for dispensing, but have limited space. Containers need to be compact, intuitive and easy to use, but also need to be able to withstand operation under less than ideal conditions, with a high frequency of use, including rough handling and bumping.

In other words, the ideal liquid dispensing container is easy to transport from truck to shelf and can be stored in a sturdy stacked configuration, which is compatible with use.

Liquid dispensing containers currently on the market, such as laundry detergent containers or fuel jerrycans, lack in comfort and ease of carry, and also fail to provide any means for stacking. One problem with existing containers is that they typically use an indented grip located on the side or top of the container. Gripping ribs 12 encourage grasping with the user's palm facing down, a position more prone to slippage than the palm up position, and that can lead to higher finger and hand fatigue. The gripping ribs positioned on the handle add grip strength and stability when carrying the container. The frequent side positioning of the handle inevitably leads to wrist discomfort, as the user must counteract the torque induced by the container's weight, since the container's center of gravity is not aligned with the handle and associated lifting force. Another problem with existing containers for this industry is the difficulty in stacking them. Typically made of plastic, their smooth surfaces offer no holds to imbricate other containers, and with additional potential for bulging, stacking is often unfeasible.

Exemplary embodiments of the present invention aim to solve one or more of the aforementioned problems.

SUMMARY

A container for storing and dispensing liquids, with at least one stacking feature, a dispenser to dispense liquid contained in the container, a handle for carrying the container, an angle (γ) which is the angle between a line (DD') perpendicular to a reference lifting plane (Lp) cutting through the handle and a line parallel to a vertical of the container in a filling orientation, and a tilt angle (B) which is the angle between the line (DD') and a line going through a location of a center of gravity of the filled container in the direction of a weight force of the container. When the container is in a filling orientation the tilt angle (B) and the angle (γ) coincide, while when the container is lifted perpendicular to the lifting plane (Lp), the tilt angle (B) is substantially zero.

A device for storing and dispensing liquids, with feet and corresponding pockets on opposing sides to stack devices next to, or on top of one another; a dispenser to dispense liquid contained in the device; protective ribs to provide structure and prevent bulging; and a t-shaped handle for carrying the device. The t-shaped handle has a top and stem, the top width being greater than the stem width, and at least part of the t-shaped handle is at a non-zero angle from a vertical in a filling orientation.

BRIEF DESCRIPTION OF THE DRAWINGS

A more complete appreciation of the depicted embodiments and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
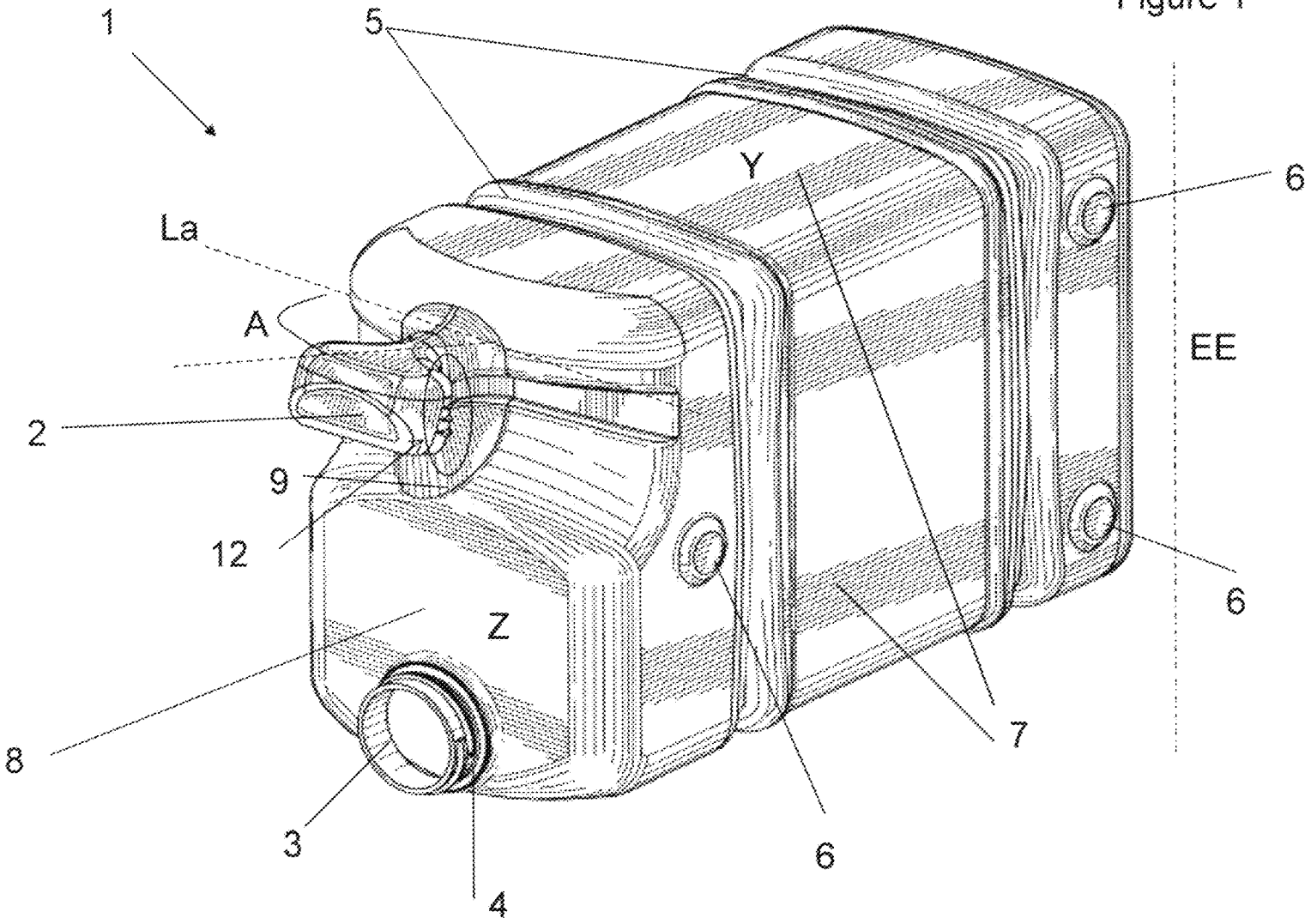
FIG. 1 is a front, top, and right side perspective view of an exemplary container.
Figure 7:
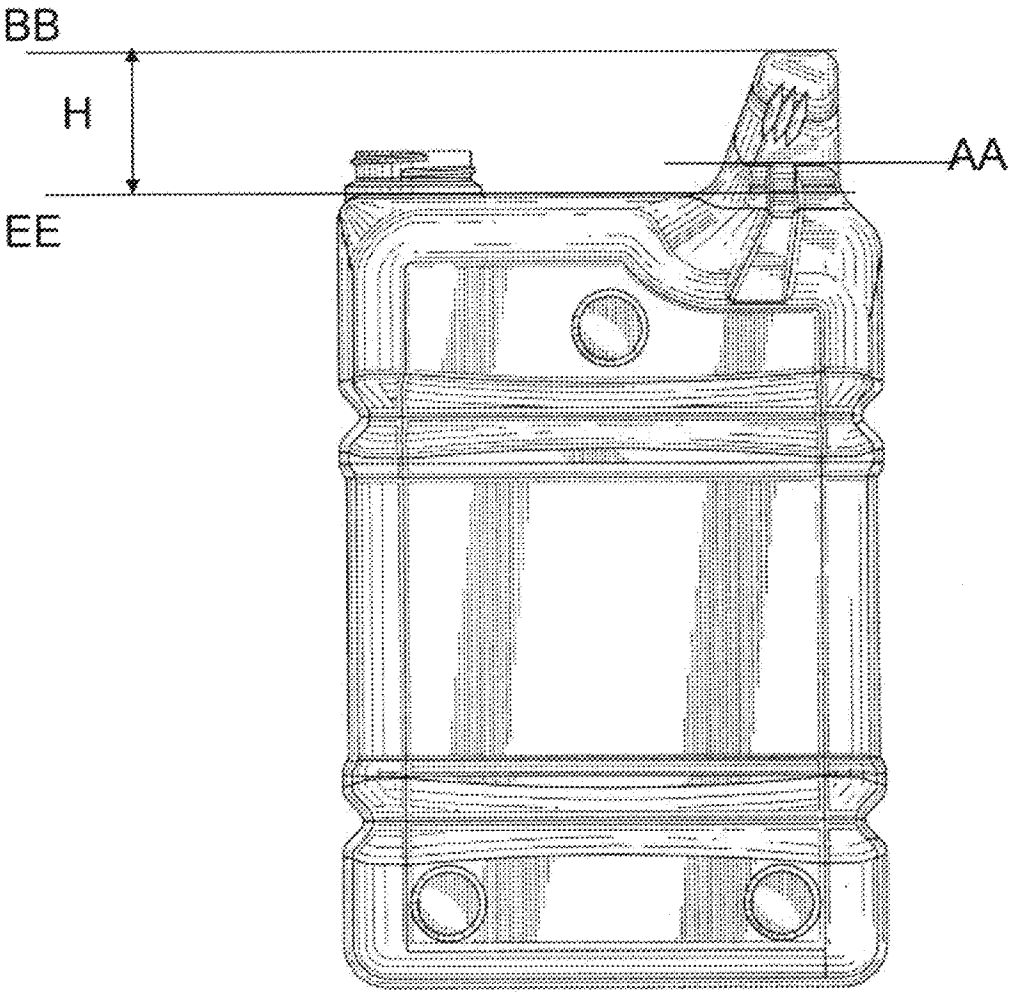
FIG. 7 is a left side elevational view of an exemplary container.
Figure 8:
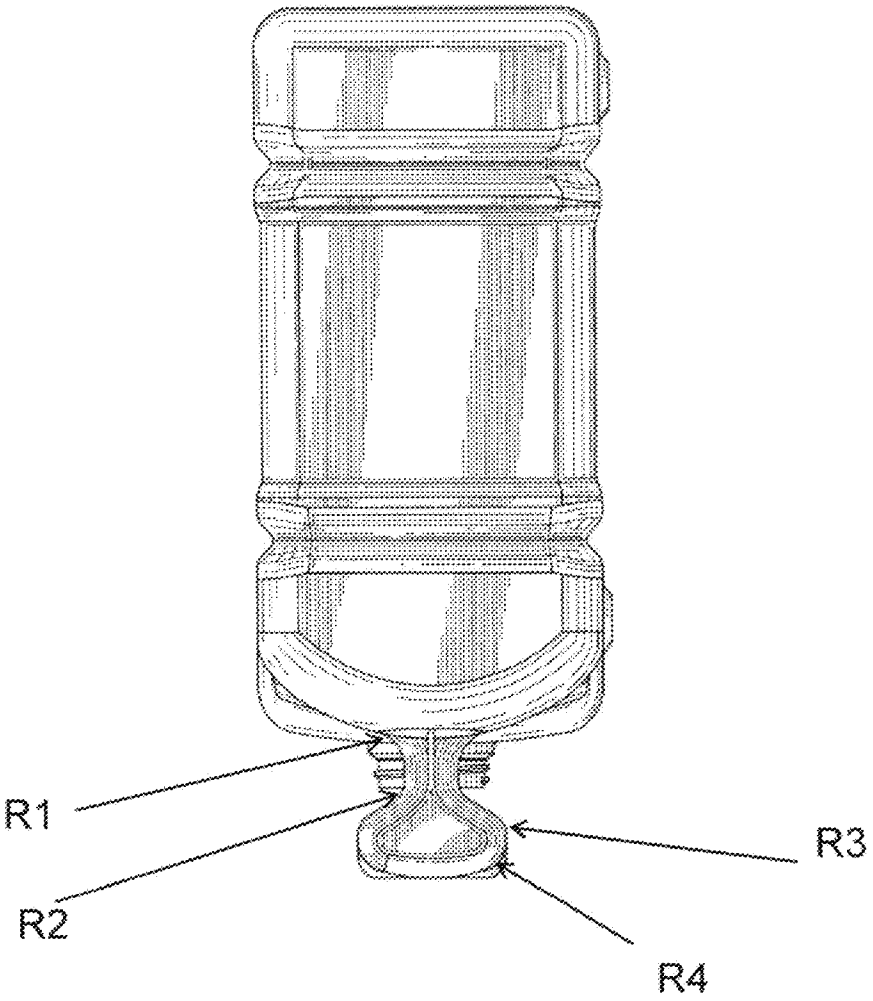
FIG. 8 is a top plan view of an exemplary container.
Figure 9:
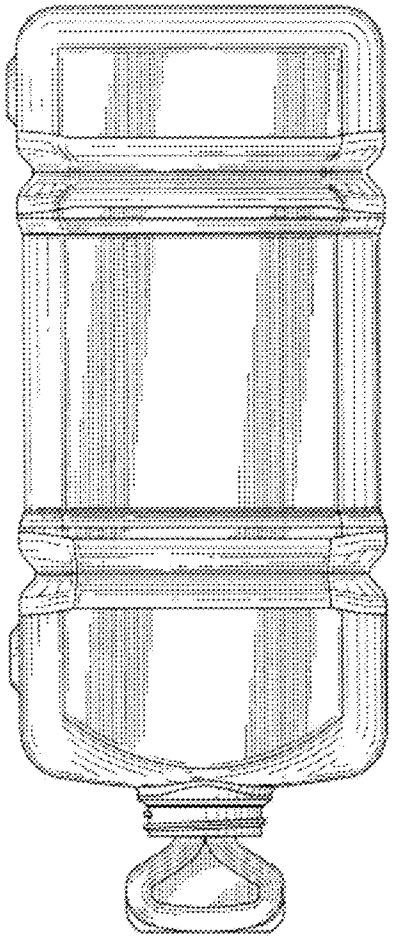
FIG. 9 is a bottom plan view of an exemplary container.
Figure 10:
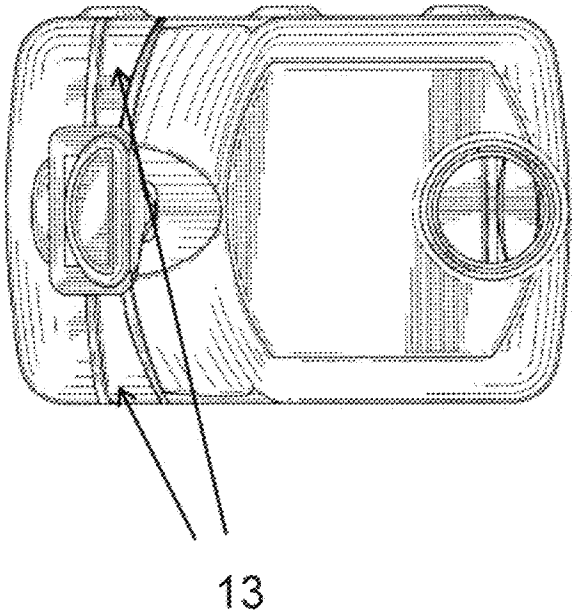
FIG. 10 is a front elevational view of an exemplary container.
Figure 11:
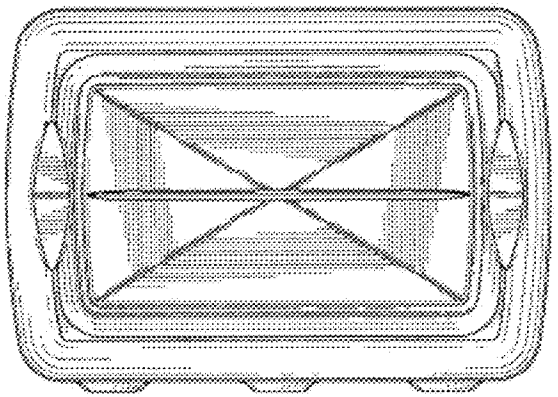
FIG. 11 is a rear elevational view of an exemplary container.

In the exemplary embodiment shown in FIG. 1, the liquid dispensing container 1 comprises a t-shaped handle 2, a dispensing feature 3, with thread 4, protective strap ribs 5, stacking features 6, a first label area 7, and second label area 8, as well as structural reinforcement in the form of strengthening ribs 9 for the handle. The strengthening ribs help prevent unwanted flexing of the handle in any direction. A width of a handle section AA, measured where the strengthening ribs end, as shown in FIG. 7, is 1.35".

The liquid dispensing container 1 is structurally sound, and capable of containing the liquid weight without any leakage or failures. High density polyethylene or polypropylene are appropriate for this application, being both lightweight and durable, yet allowing for some deformation to be expected from the contents. High density polyethylene or polypropylene are easy materials to manufacture containers from, using a blow molding process. The use of PET in an extrusion molding process would also be possible in this application if a visually clear container were desired. To further strengthen the container, integrated sets of protective strap ribs 5 surround the container and provide reinforcement against excessive bulging. The base of the handle is reinforced by integrated structural reinforcement 13 to prevent failure. FIGS. 7-11 show different views of an exemplary embodiment.

Use tests with chefs were carried out and led to improved dispenser features, stacking features, and handle design. The container is expected to be used in a restaurant kitchen setting, and is designed to provide a corresponding ornamental appearance and functionality. This no-nonsense policy is exemplified by the preferred container's simple and square or rectangular appearance. The container sits reliably on a shelf, and preferably displays no unnecessary frills.

The space between the protective ribs 5 serves as a first label area 7, for content identification. Should this label area be hidden given the stacking orientation of the containers, there exists a second smaller label area 8 located above the dispenser feature for identification of the contents when dispensing. Stacking features 6 consist of protrusions or feet on one side, and corresponding pockets on the other side, to allow chefs to save valuable shelf space with horizontal stacking of the containers. Protrusions and pockets are positioned on either end of their respective container faces, leaving sufficient room for a label to be placed on the container's sides. In an exemplary embodiment protrusions and corresponding pockets may be circular.

The dispenser feature is circular and threaded, with only one turn of thread at full depth. This allows for quick opening and closing, compatible with the anticipated fast paced environment. The dispenser is also, in the filling orientation in a preferred embodiment, flush with the handle feature and on the same side as the handle, making it easier to package, and harder to damage during shipping. The dispenser feature is adjacent to the container's sidewall, such that when pouring contents from the container, there is no ledge onto which the contents could drip. This feature may reduce spillage. Variable dispensing quantities, depending on the product or application, could vary from 1 oz to 8 oz. In an exemplary embodiment, the dispensing feature could also take the form of a thread-on or snap-on device to meter out the liquid by a spigot or measured-dosing means.

Two strap ribs are set in approximately a third of the distance from either end of the container which provides both structural support to the container and a sufficiently sized label panel area.

In an exemplary embodiment, a height H of the handle defined between surfaces BB and EE, as shown in FIG. 7, may be between 2 and 3 inches. Preferably, a height H of the handle may be nominally 2.850 inches.

Figure 6:
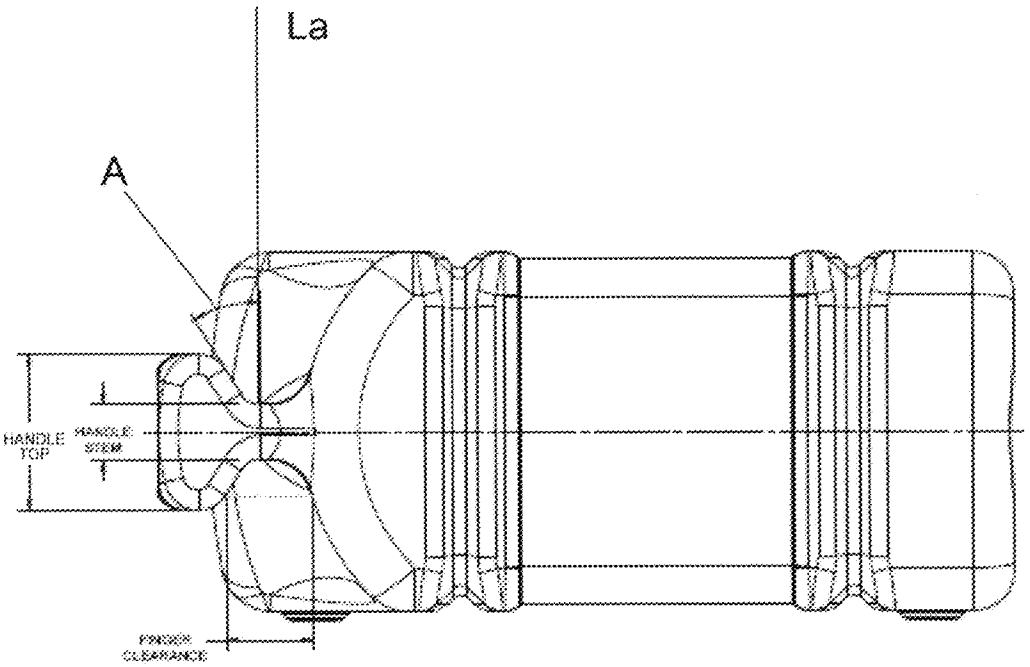
FIG. 6 is a top plan view of an exemplary container.

In an exemplary embodiment, a handle top width, as shown in FIG. 6 may be between 2 and 2.5 inches. In a preferred embodiment, a handle top width may be nominally 2.28 inches.

The preferred embodiment's uses two strap ribs located 3.38" from one another. Stacking means for the preferred embodiment consist of three feet on a first side face and three pockets on an opposite side face. Three stacking features allow containers to stack reliably and effectively. Two stacking features would not have been as reliable to prevent slippage, while four stacking features would have changed the container shape.

Sizing of the container could range from 32 ounces to 2 gallons (256 ounces) as the container is aimed at the Food Service Industry where bulk quantity product is regularly used. The container weight and shape is also intended to allow carrying of two containers at a time, which would not be feasible for larger containers. In addition, sizing is related to the expected nature of the contents, likely perishable products, so that larger containers would lead to waste, and smaller containers would lead to an undesirable increase in container consumption. The container may be used for instance to hold wing sauces and salad dressings or other liquid food products. Such items, which are frequently used in restaurants, would benefit from the container size and shape, with a container serving the needs of a daily or weekly service volume. The container's contents will last a reasonable period of time to prevent rapid container replenishment yet assure food safety.

Depending on the container fill level 11, its weight and the position of its center of gravity varies, but the handle remains comfortable at any weight. In an exemplary embodiment, the handle itself is hollow, allowing fluid to be present in the handle cavity when the container is carried.

Figure 2:
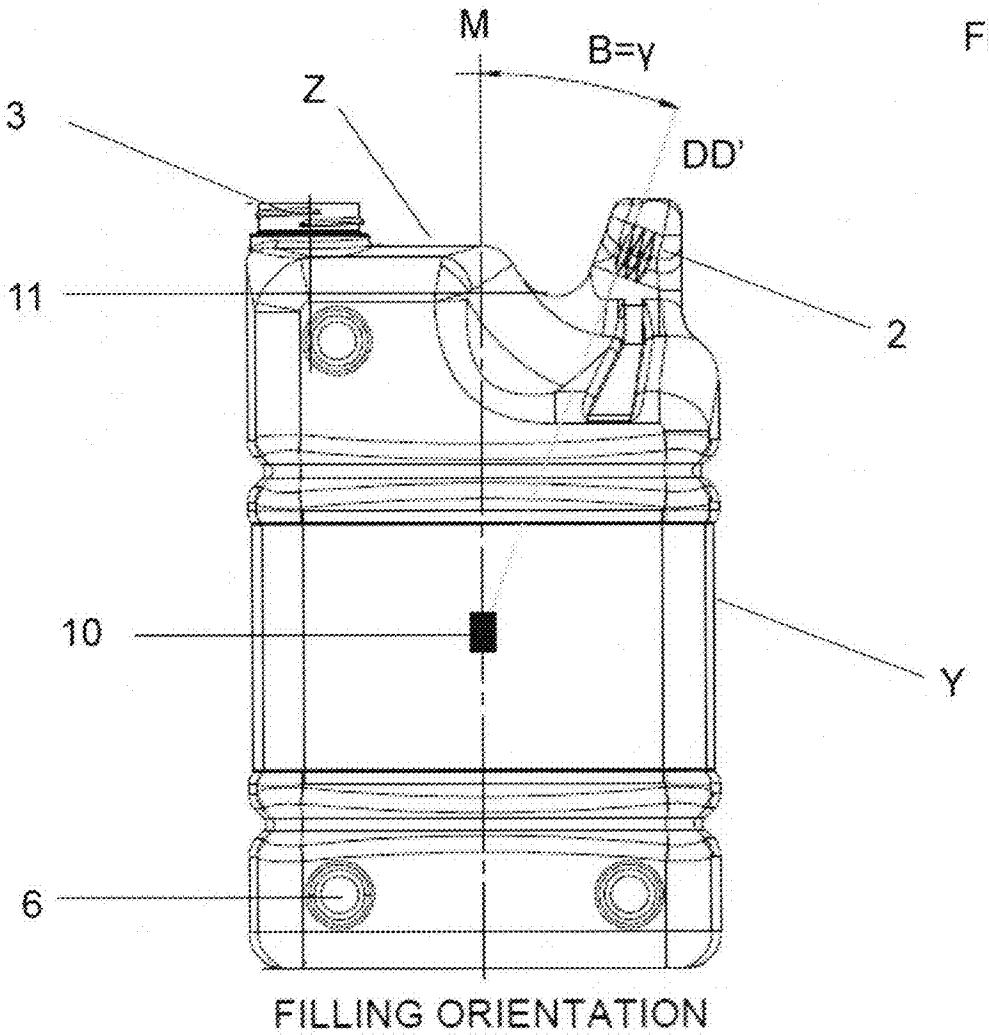
FIG. 2 is an elevational view of an exemplary container in its filling orientation.
Figure 12:
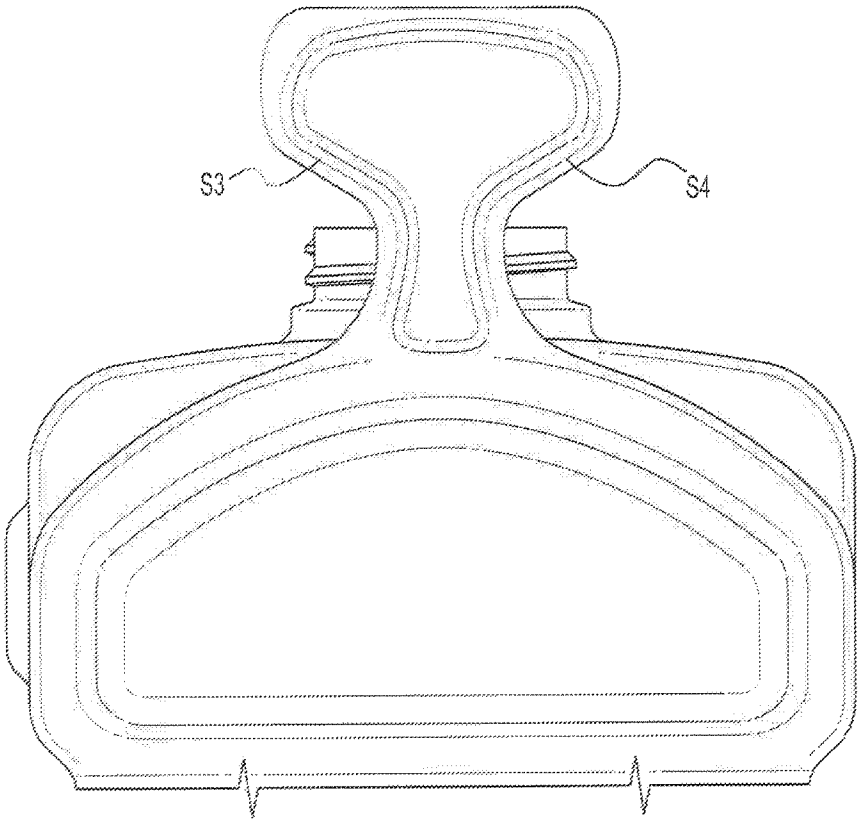
FIGS. 12-18 are elevational views of an exemplary container handle separated by 15 degrees.
Figure 13:
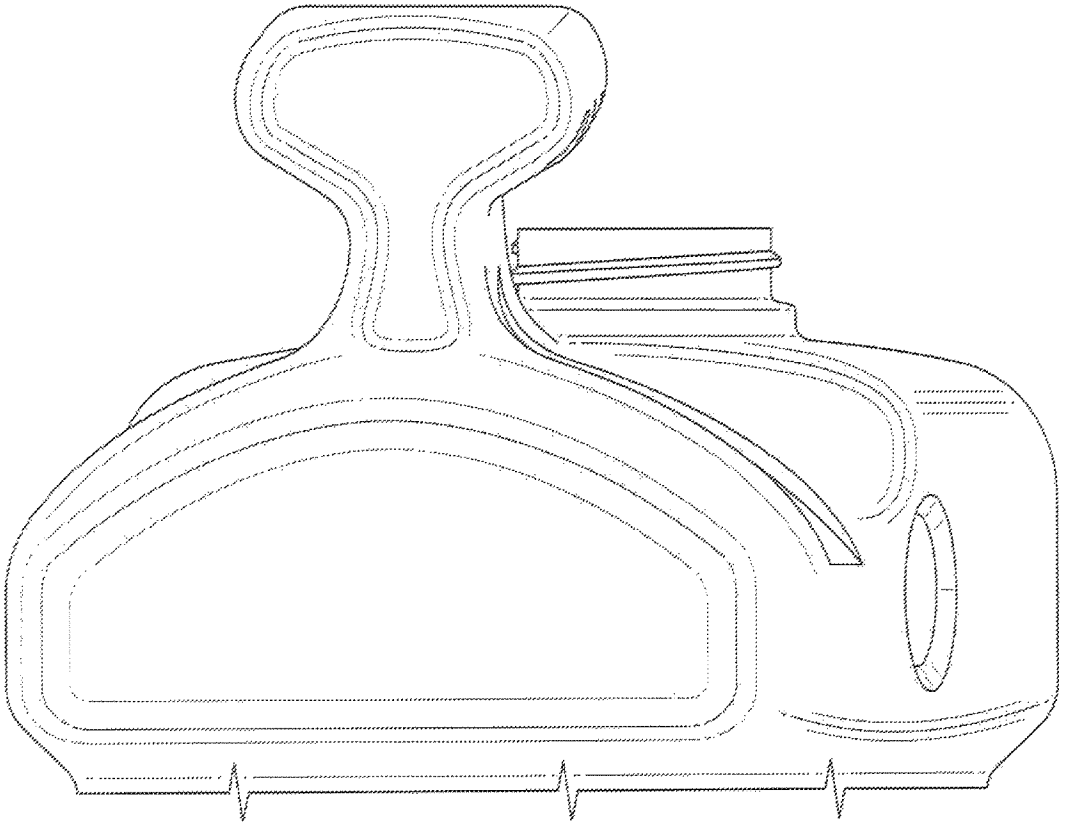
Figure 14:
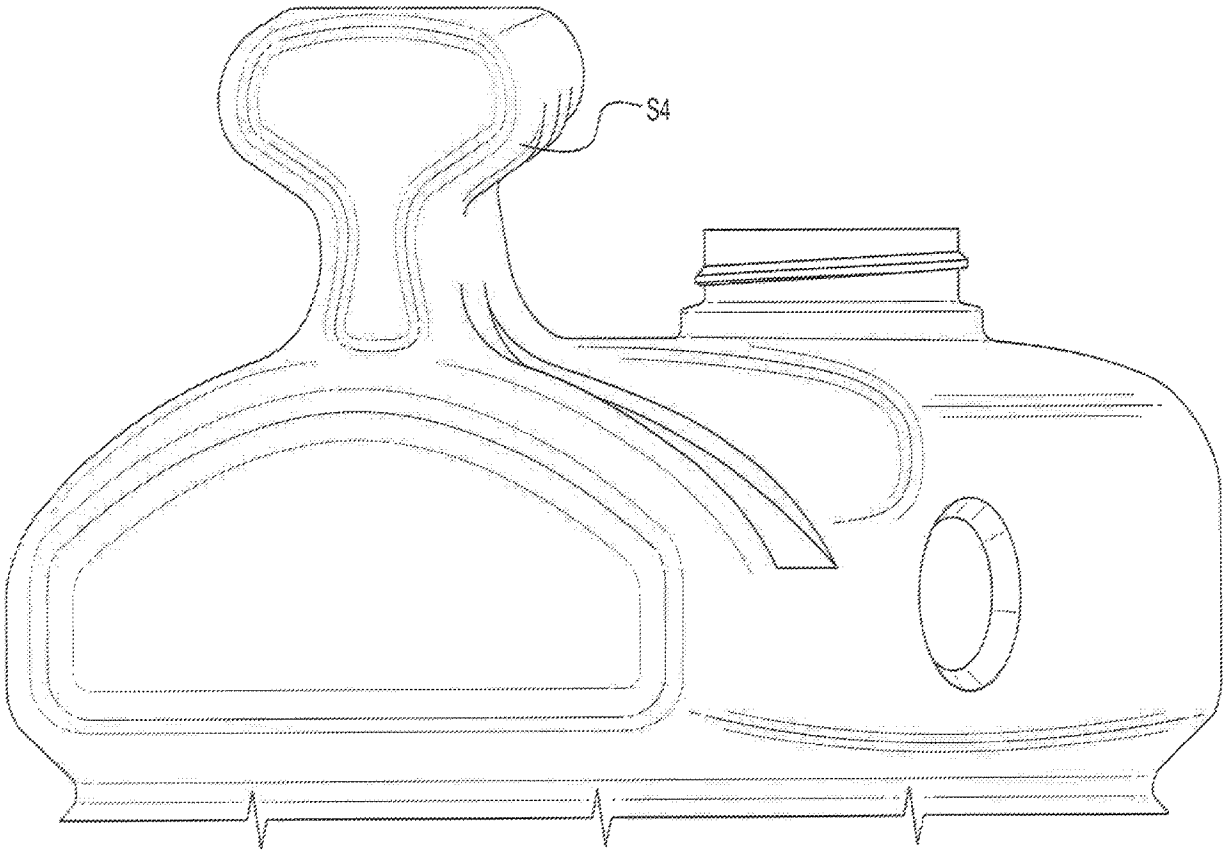
Figure 15:
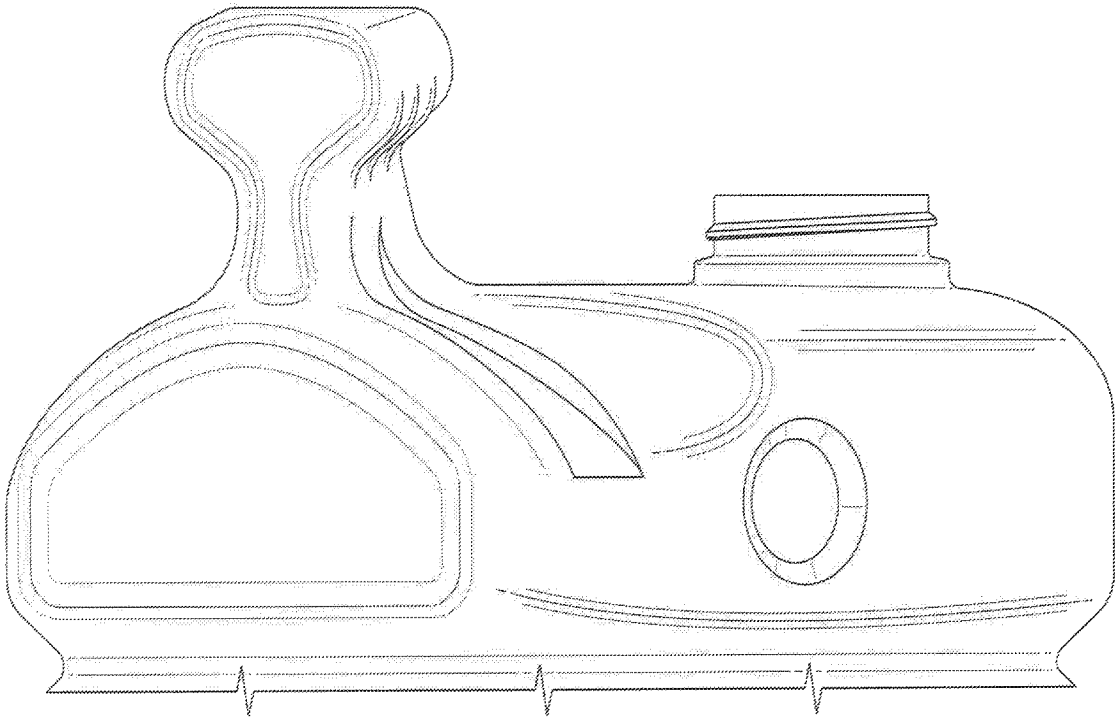
Figure 16:
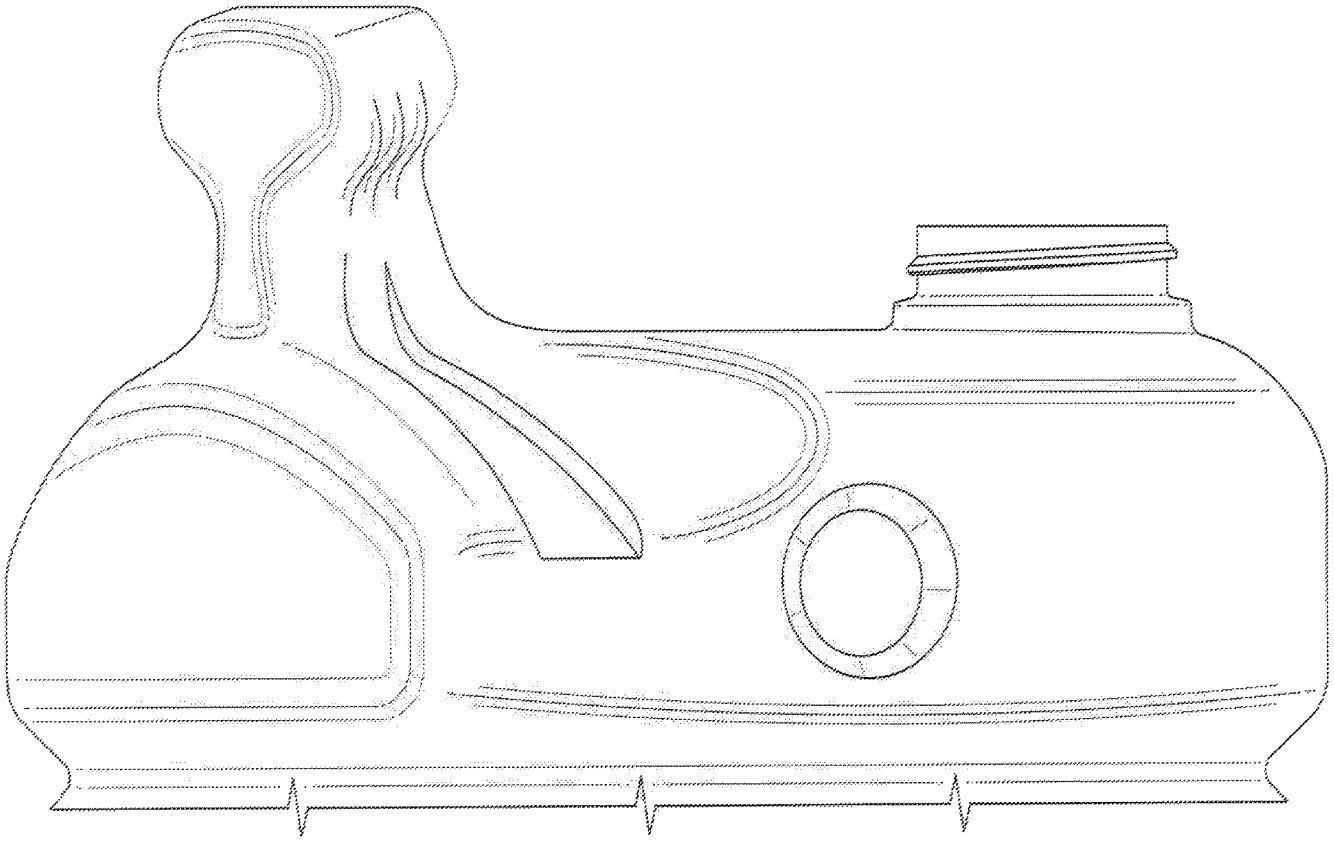
Figure 17:
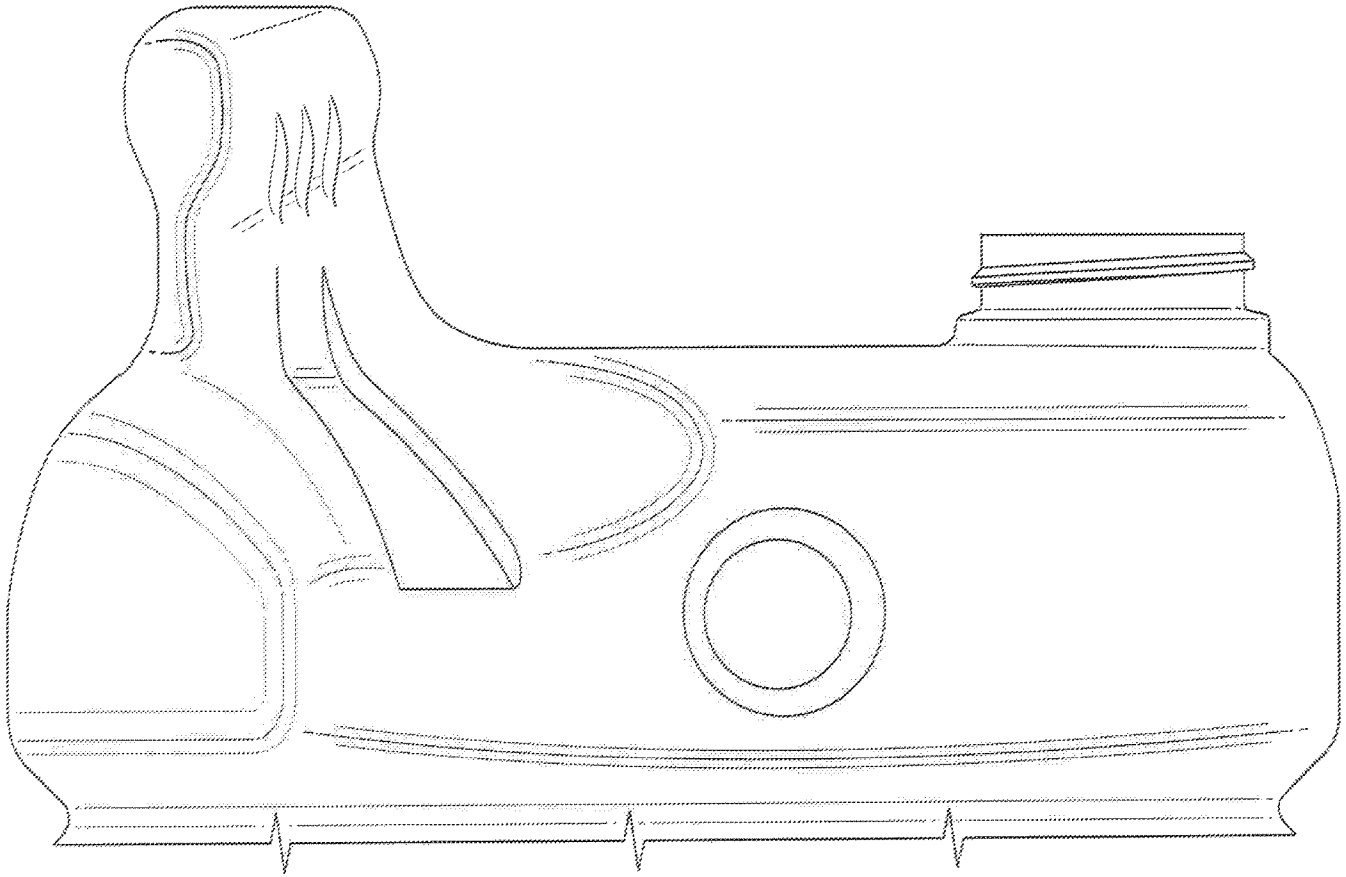
Figure 18:
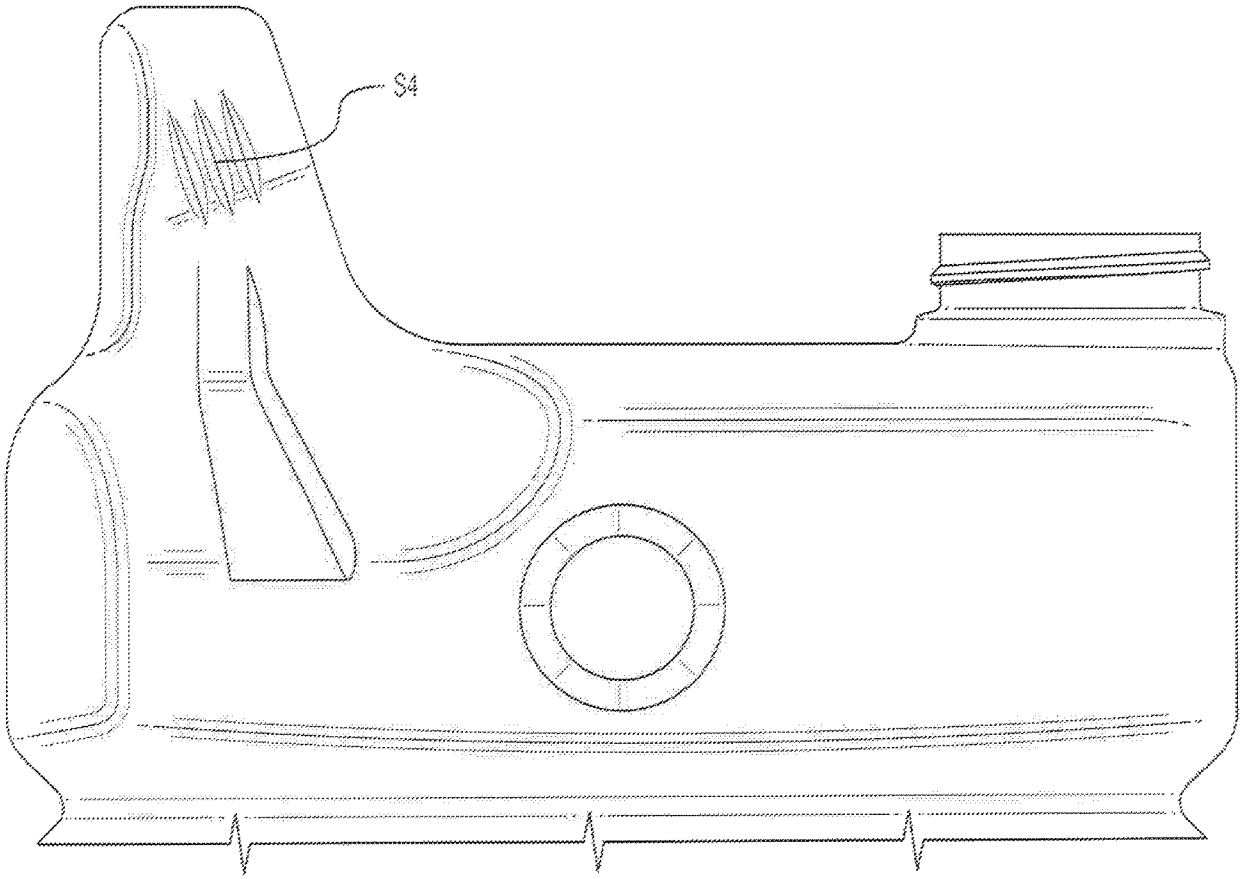
Figure 19:
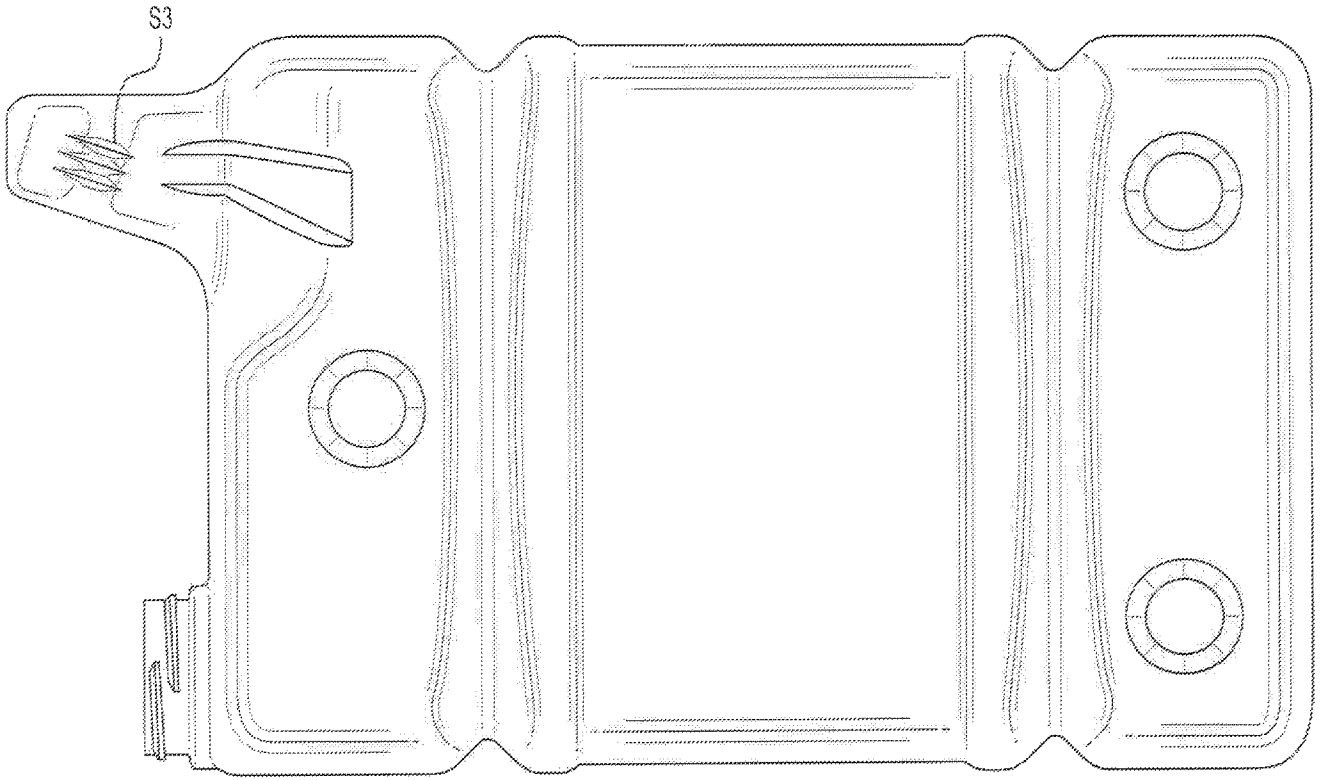
FIGS. 19-25 are elevational views of an exemplary container.
Figure 20:
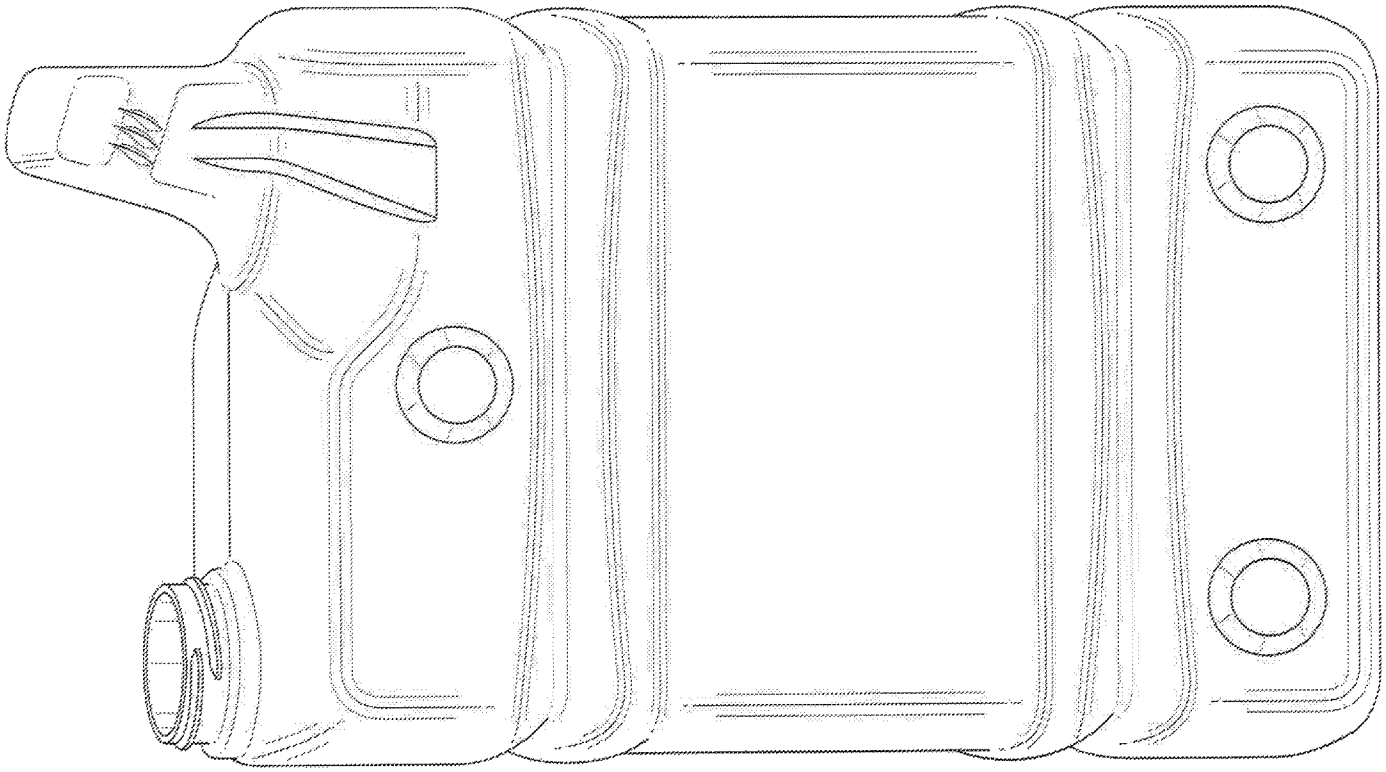
Figure 21:
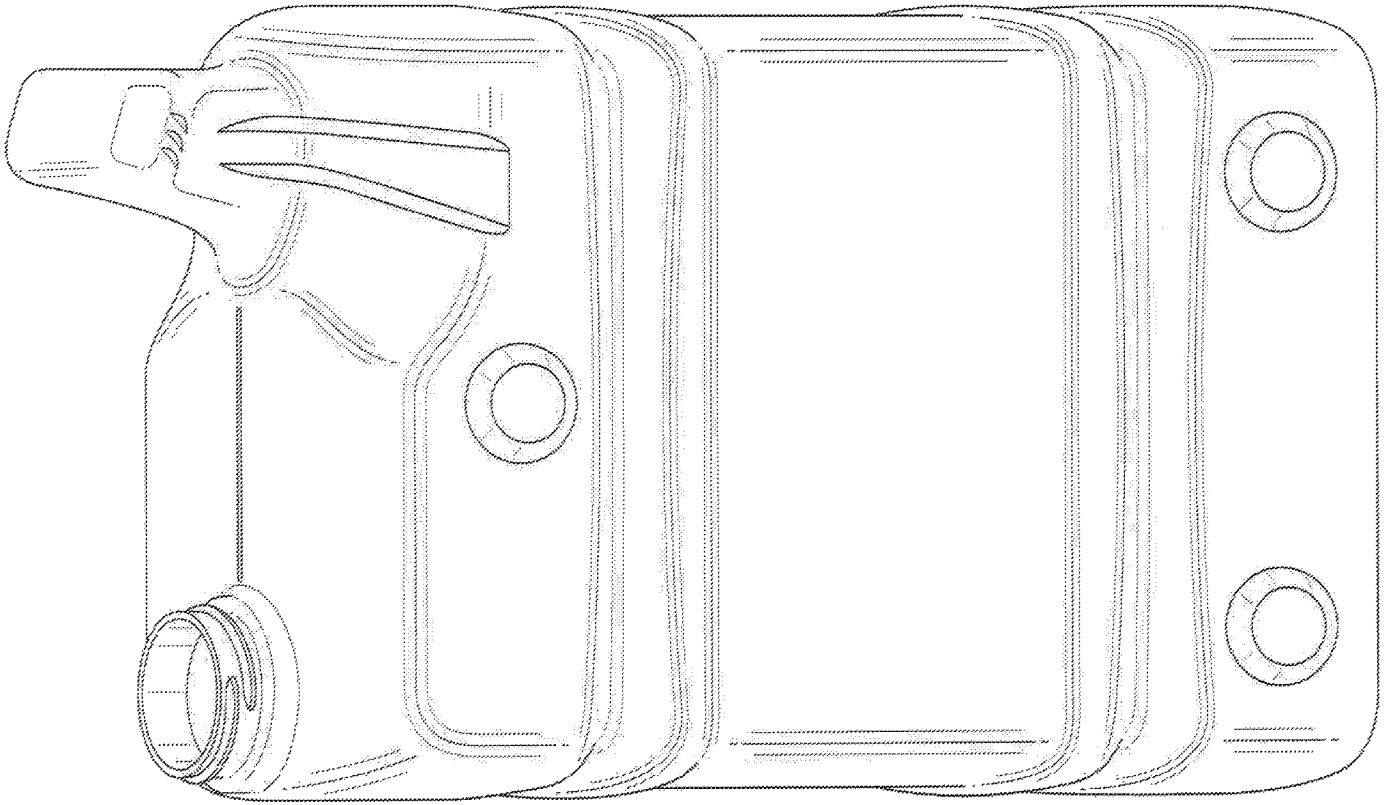
Figure 22:
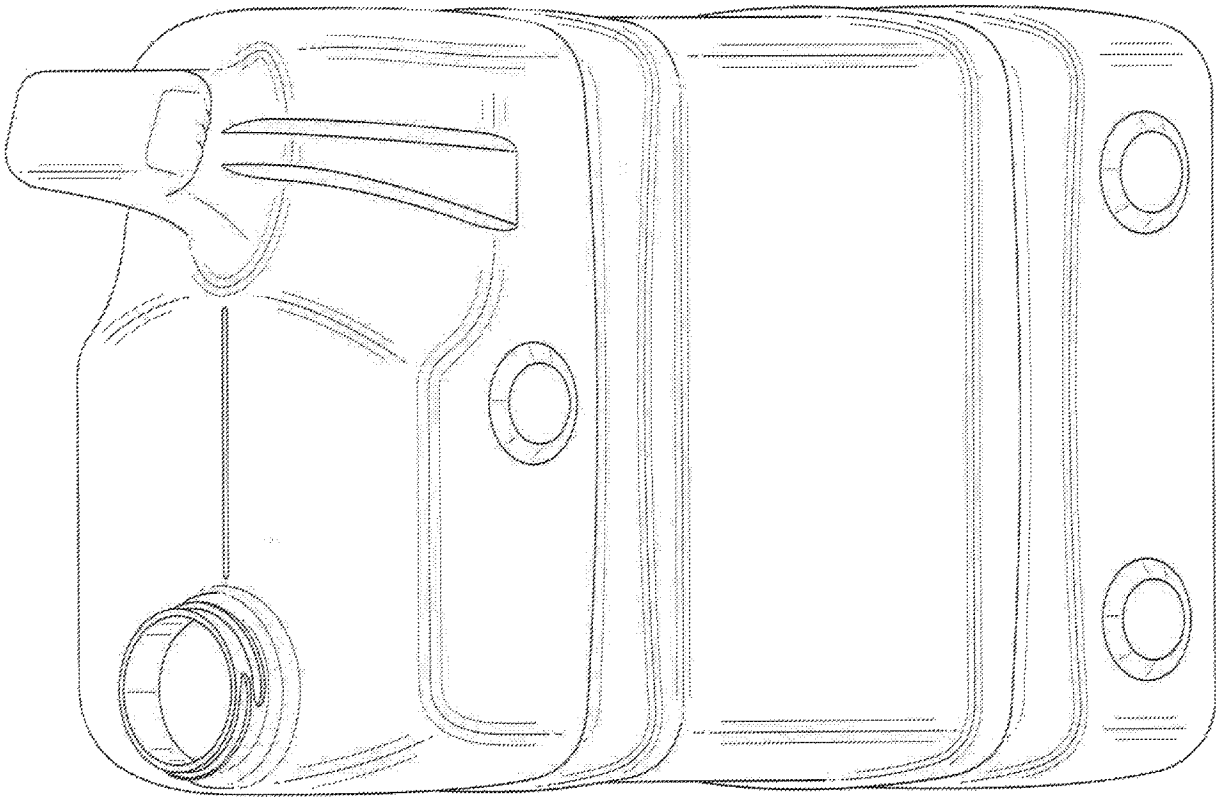
Figure 23:
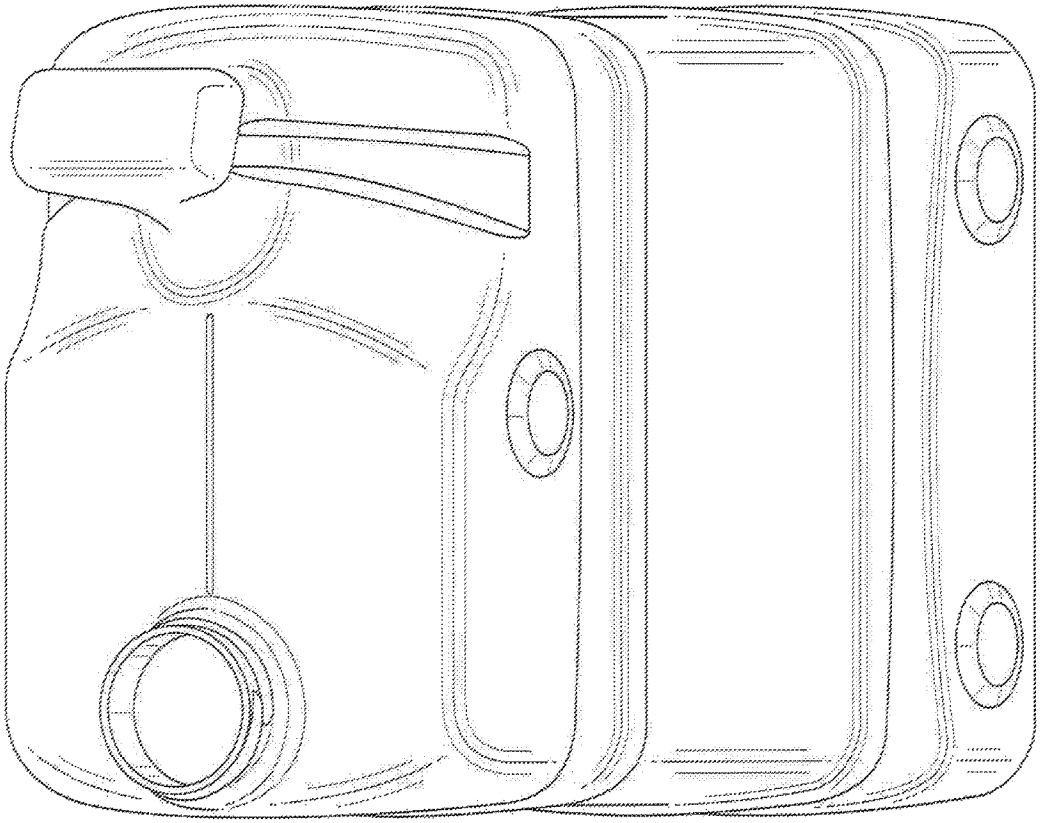
Figure 24:
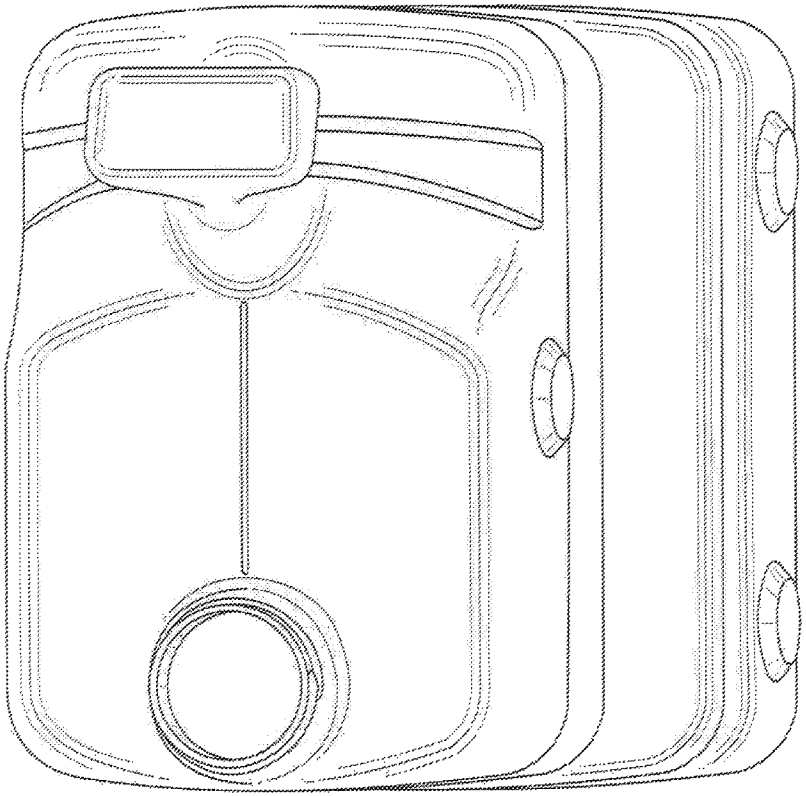
Figure 25:
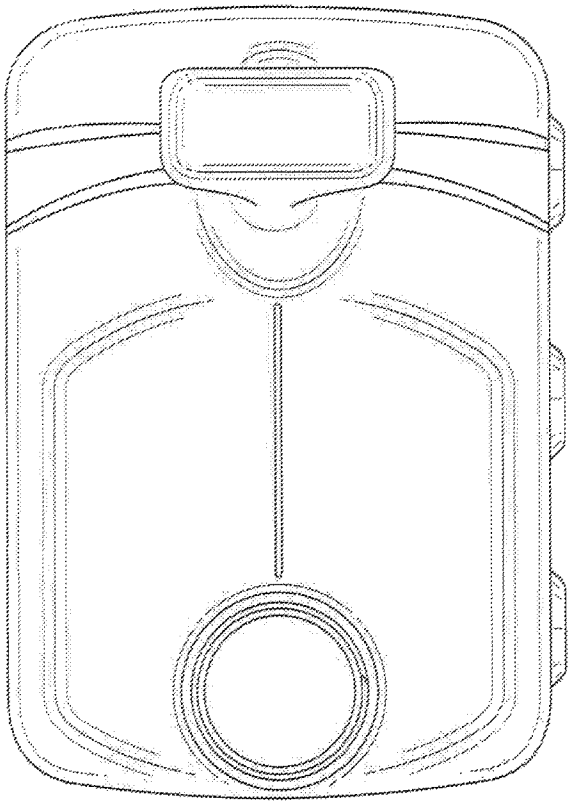

The handle geometry is defined with at least two angles. As shown in FIGS. 1 and 6, slant angle A is defined in a top view plane as the angle between an underside surface of the handle (i.e., the two side surfaces (S3 and S4, see for example FIGS. 12, 18 and 19) of the handle which press onto a user's fingers when the container is held by one hand as shown in FIG. 3) and a plane substantially parallel to a side of the container from which the handle projects at the handle stem (La indicated in FIGS. 1 and 6). FIG. 2 is representative of an exemplary container's filling orientation. As shown in FIG. 2, geometric angle (γ) is the angle between a line (DD') perpendicular to a reference lifting plane (Lp) which cuts through the container, and a line parallel to a vertical of the container in a filling orientation. When the container is lifted, the lifting plane (Lp) is perpendicular to the weight force of the container. When the container is lifted, the lifting plane (Lp) is parallel to the presumably flat ground, as also discussed later on. Tilt angle (B) is also indicated on FIG. 2, and is defined by the line (DD') and a line (M) going through a location of a center of gravity (10) of the filled container in the direction of a weight force of the container. Alternately, angle (γ) may be defined as the angle between a lifting plane (Lp) and a perpendicular to the midline (M). Referring to FIG. 6, a preferred embodiment may have a stem 0.7 inches wide, a top 1.9 inches wide, slant angle A of nominally 31 degrees, and geometric angle (γ) of nominally 18 degrees.

The location of the handle is preferably such that the base of the handle may be above the midline of a container side (e.g., midline M of side Z in FIG. 2). More preferably, the entire handle 2 is located above the midline M of the container side which also has an opening 3 for filling the container (e.g., side Z in FIG. 2). Still more preferably, the handle 2 is closer to an end of a side from which the handle projects than to a midline of the side from which the handle projects (see, e.g., FIG. 2). In some embodiments, the handle base is located a distance between 0% and 30% of a length of the container side Z from which the handle extends, where 0% is one end of side Z and 100% is the opposite end of the side Z. In still other embodiments, the handle base is located between 0% and 25%, 5% and 25%, 5% and 20%, or 10% and 20% of a length of the container side from which the handle extends.

The shape of the handle takes into account comfort and strength considerations, integrated in an ergonomic design, as a result of several group studies with chefs and restaurant personnel. FIGS. 12-18 show perspective views of an exemplary embodiment of the container handle, with each view rotated 15 degrees from the previous one. Similarly FIGS. 19-25 show perspective views of an exemplary embodiment of the container, with each view rotated 15 degrees from the previous one.

The geometry of the handle may be such that it is convenient to carry. The gradual width decrease of the handle from top to stem, and its overall orientation allow for an easy grab, a secure carry, and reduced user fatigue. In a preferred embodiment, the handle uses a rounded stem, with radii R1-R4, as indicated on FIG. 8, which are respectively 0.625", 0.250", 0.375" and 0.4375". Furthermore, two containers can be carried together in one hand, as shown in FIG. 3B, leading to potentially large time gains, specifically during unloading operations with two containers in each hand. Whereas with traditional indent handles, only large hands may have been able to carry two containers in one hand, the present t-shaped handle enables easier simultaneous carry for hands of all sizes.

The handle's shape and dimensions may provide an ergonomic benefit when carrying and handling the containers, developed based on customer surveys for feel and fit. With a typical round or t-shaped knob such as a door knob, users intuitively grab the door knob in their palm, grouping all fingers but the thumb to wrap around the knob, to grip and exert a twisting motion.

Instead, in this application with containers packaged in an upright position, the t-shaped handle faces up, such that the user would position his fingers, thumb excluded, on either side of the handle in a hook-like fashion, and pull palm-up to extract the container from its shipping packaging. The positioning of the handle allows, in a palm-up lifting position, the lifting force to go through the container's center of gravity (CG), thereby minimizing any moment, and associated discomfort. A similar hook-like motion would be used to remove the container from a shelf and pour sauce to dispense. The palm-up position reduces the risk that the holder's hand might slip, when carrying heavy objects, and as such is used by Emergency Medical Technicians to carry stretchers. For chefs whose hands are likely to be wet or slippery when cooking, the ability to use the palm-up grip is a net improvement over existing containers. It is noted that the t-shape handle and its intended intuitive palm up use provides an effective grip for hands of all sizes, whereas smaller or bigger hands may have been limited or inconvenienced by traditional indent handle designs.

Figure 26:
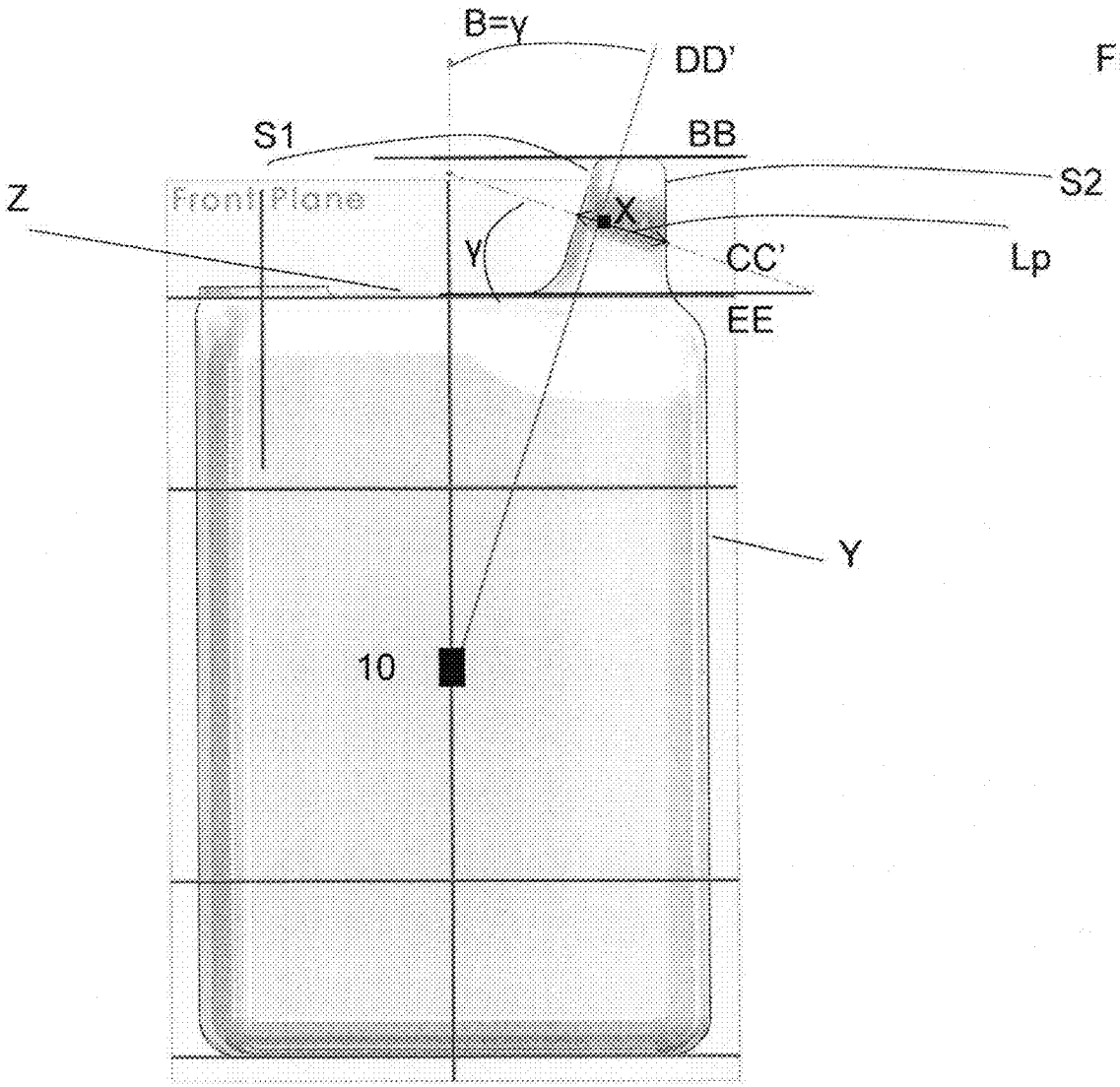
FIG. 26 is a simplified view of an exemplary container.
Figure 27:
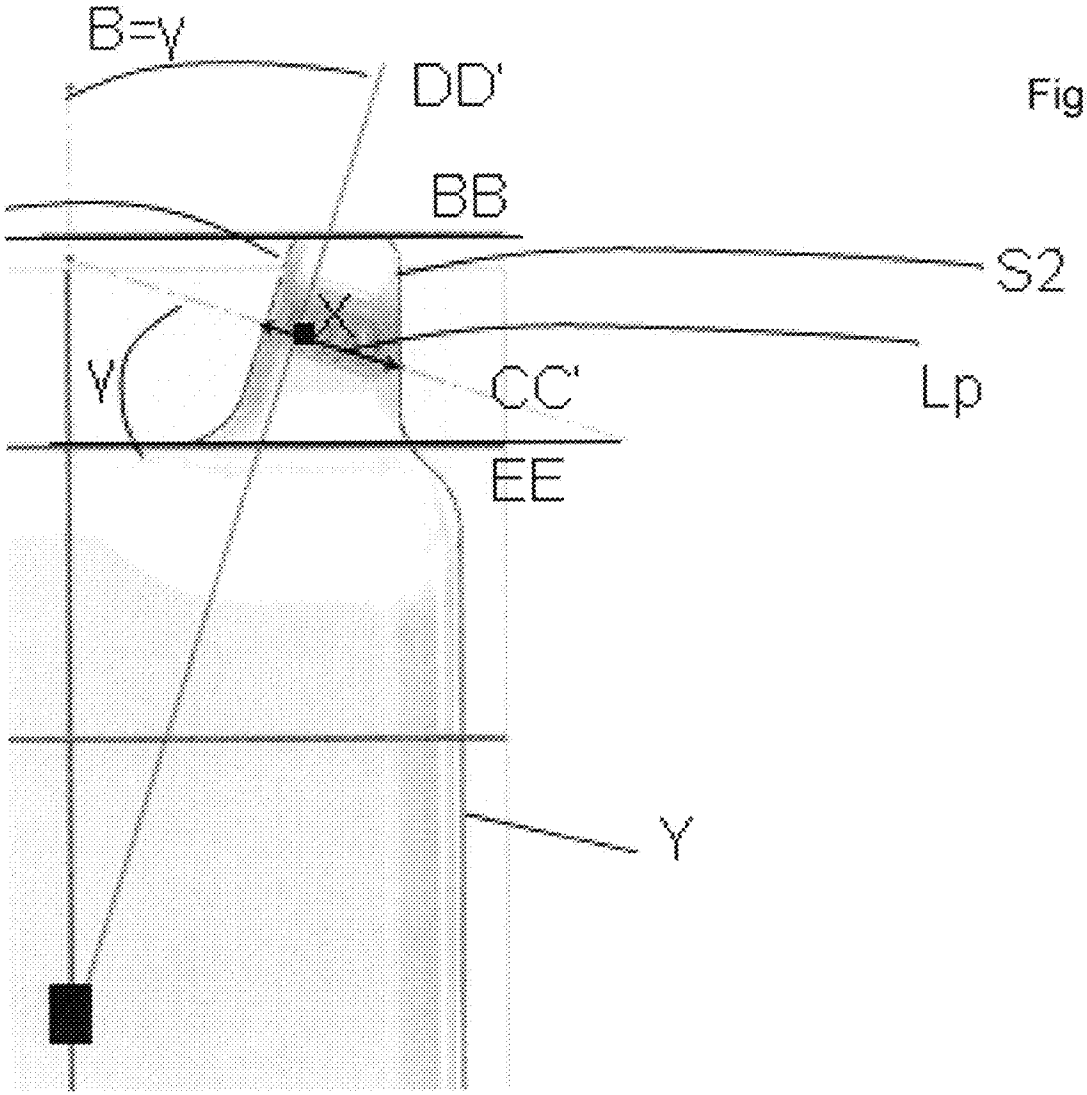
FIG. 27 is an enlarged simplified view of an exemplary container.
Figure 28:
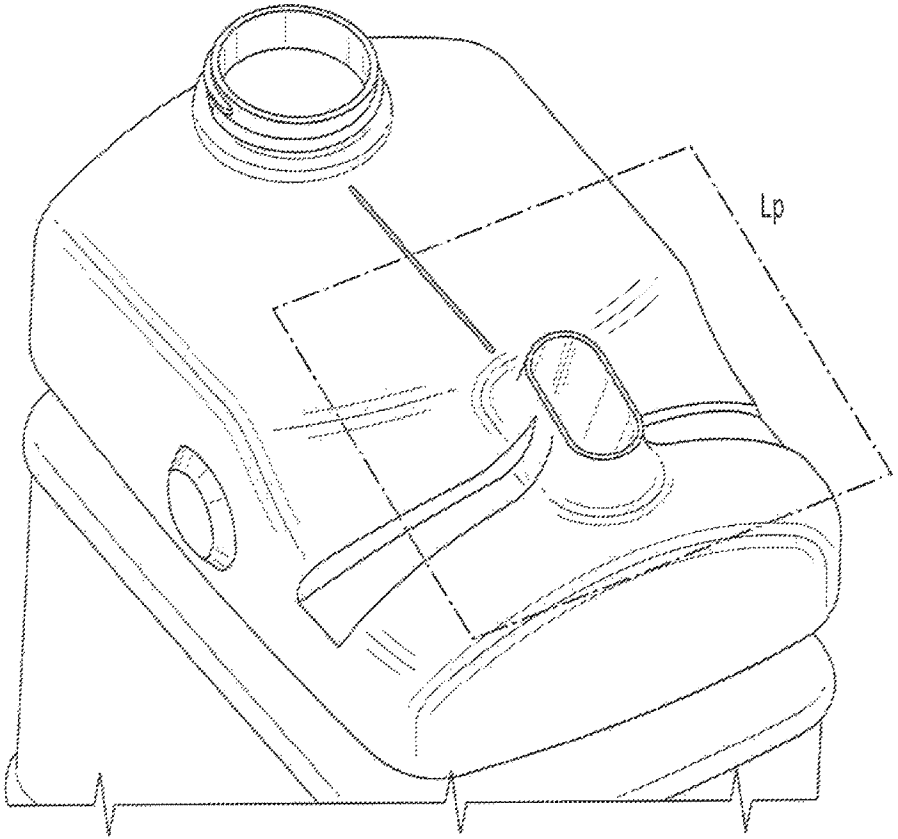
FIGS. 28-32 are perspective views of a truncated container.
Figure 29:
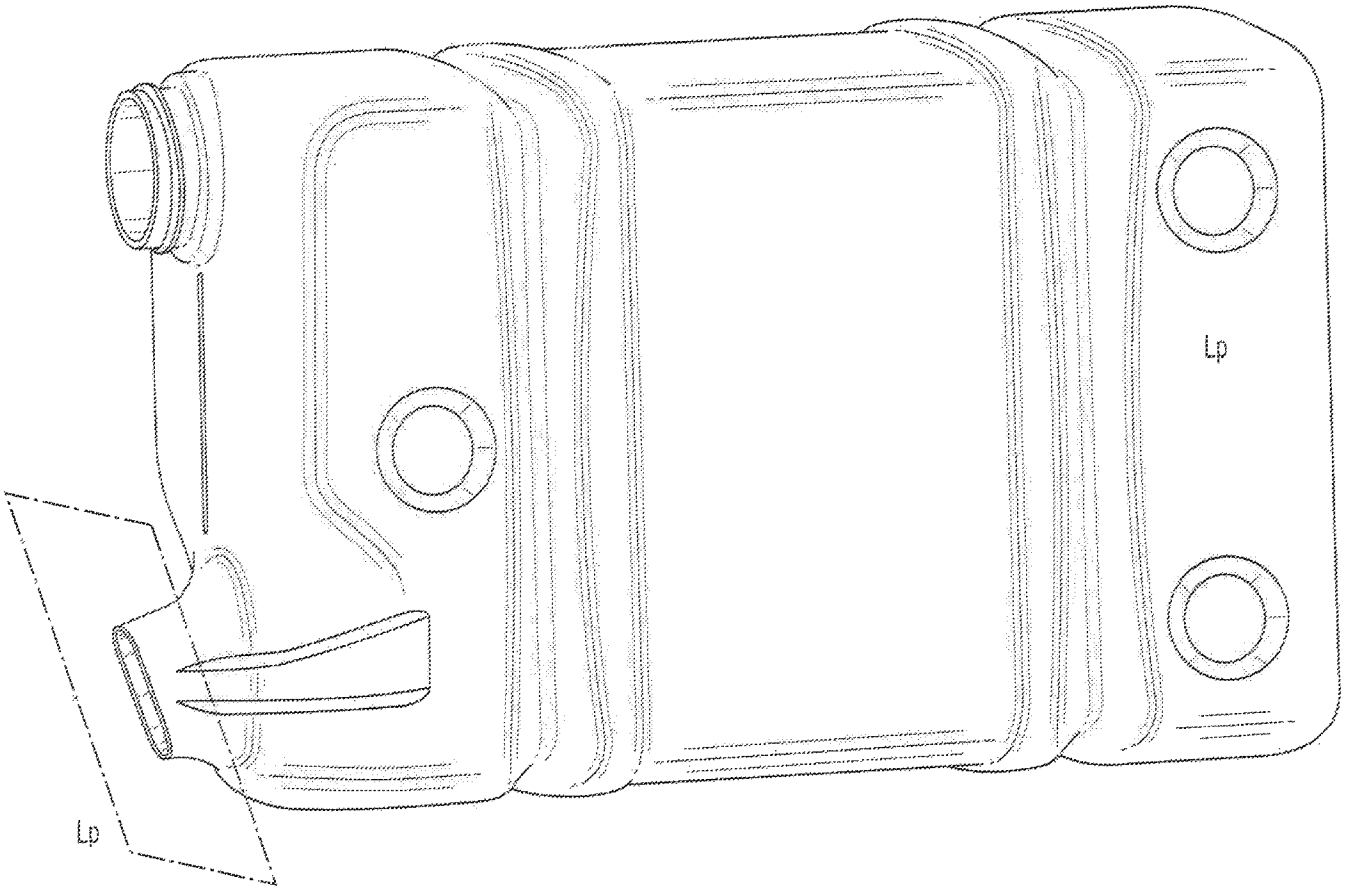
Figure 30:
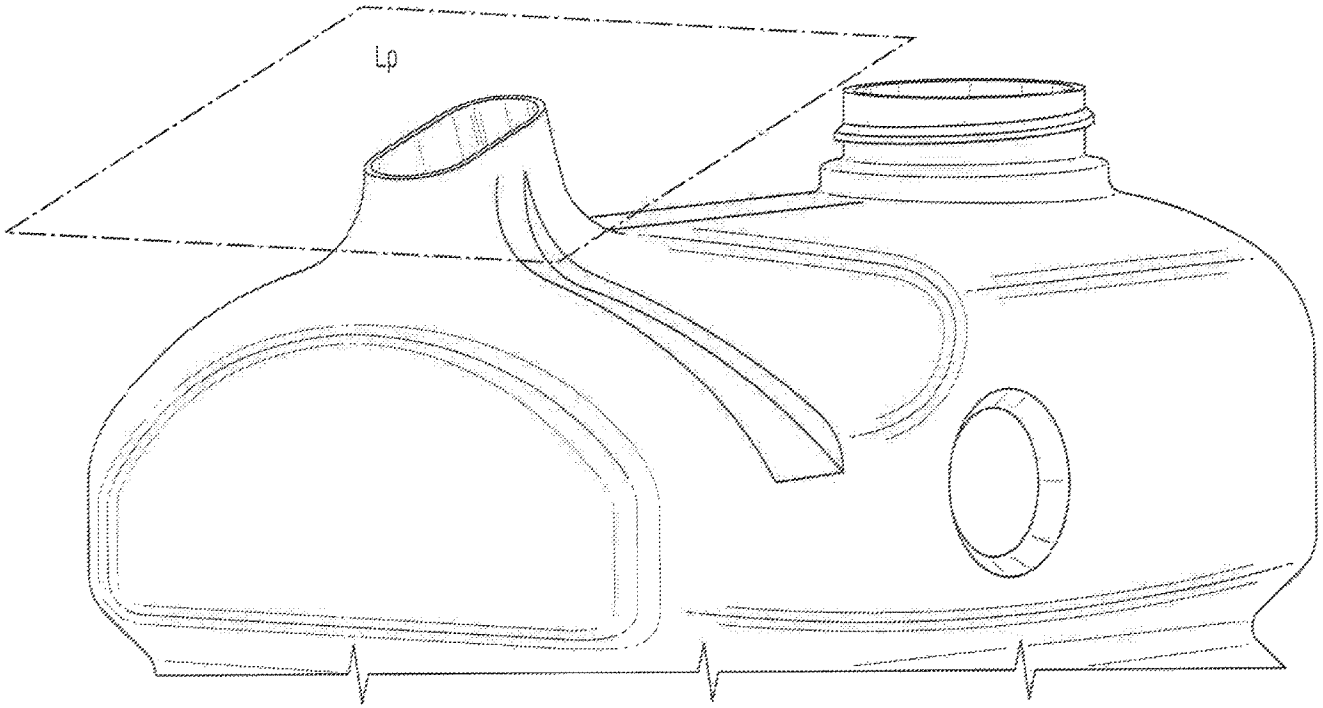

FIG. 26 is a simplified sketch of an exemplary embodiment of the container, showing an exemplary embodiment of the handle orientation and position. FIG. 27 is an enlarged simplified sketch of the container handle. In the front plane indicated in FIG. 26, the top side Z of the container may be substantially flat, as shown by the line EE, and the top of the handle may also be substantially flat as shown by the line BB. In addition, the lifting plane Lp is shown in FIG. 26, which is a reference plane cutting through the handle. In a preferred embodiment, handle surfaces S1 and S2 shown in FIG. 26 are not parallel to one another. In some embodiments, as in FIG. 26, handle surface S2 is parallel to a container side Y, which may be perpendicular to the side Z from which the handle projects. In some embodiments, a first flat side of the handle stem is perpendicular to a side from which the handle extends, and an opposite flat side of the handle stem is not parallel to the first side. In some embodiments, a first flat side of the handle top is perpendicular to a side from which the handle extends, and an opposite flat side of the handle top is not parallel to the first side. In some embodiments a first and second surface of the handle top are not parallel to each other. In some embodiments a first and second surface of the handle stem are not parallel to each other.

FIGS. 28 through 32 represent a truncated view of the container, at the location of the lifting plane Lp.

Figure 31:
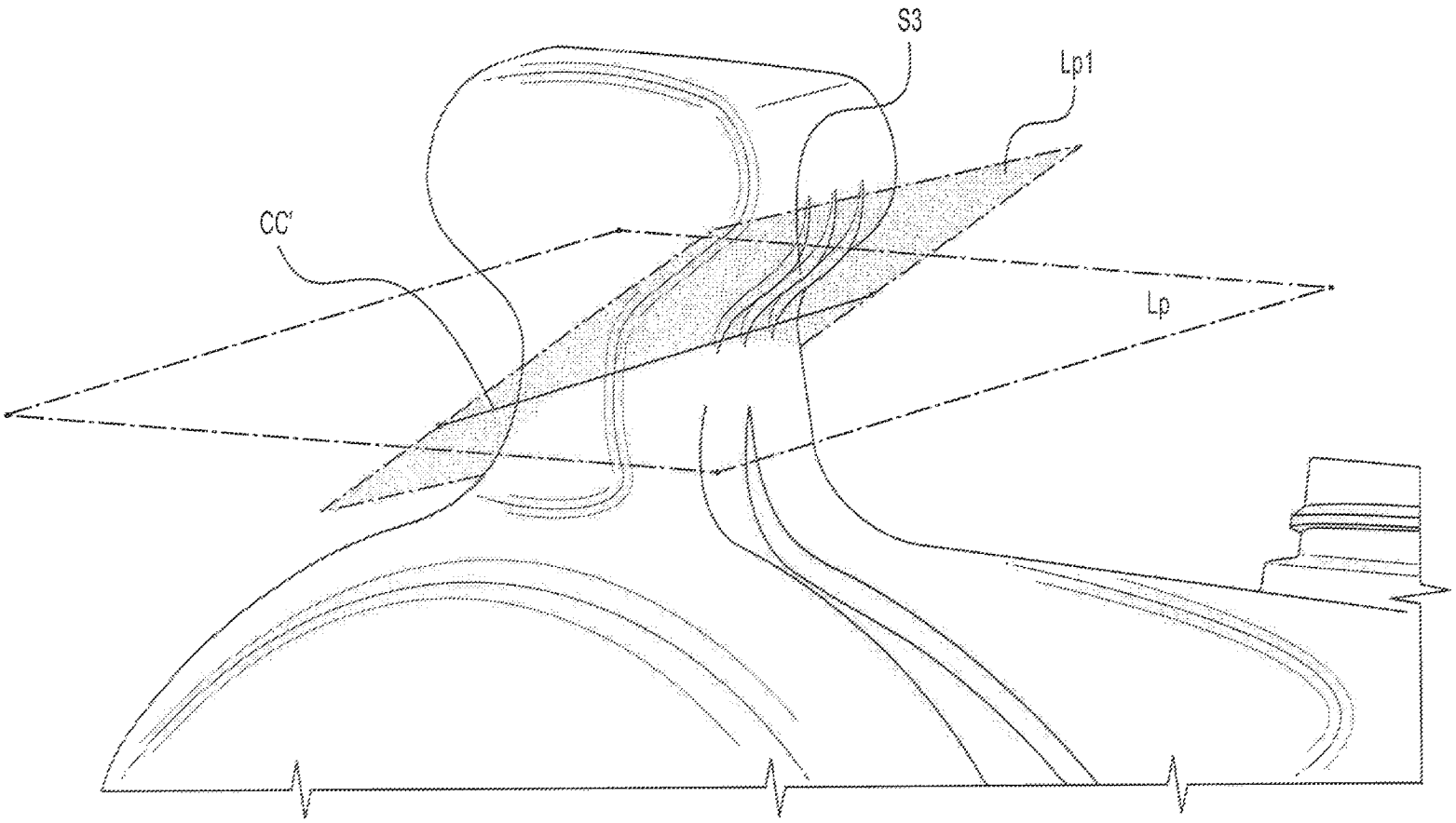
Figure 32:
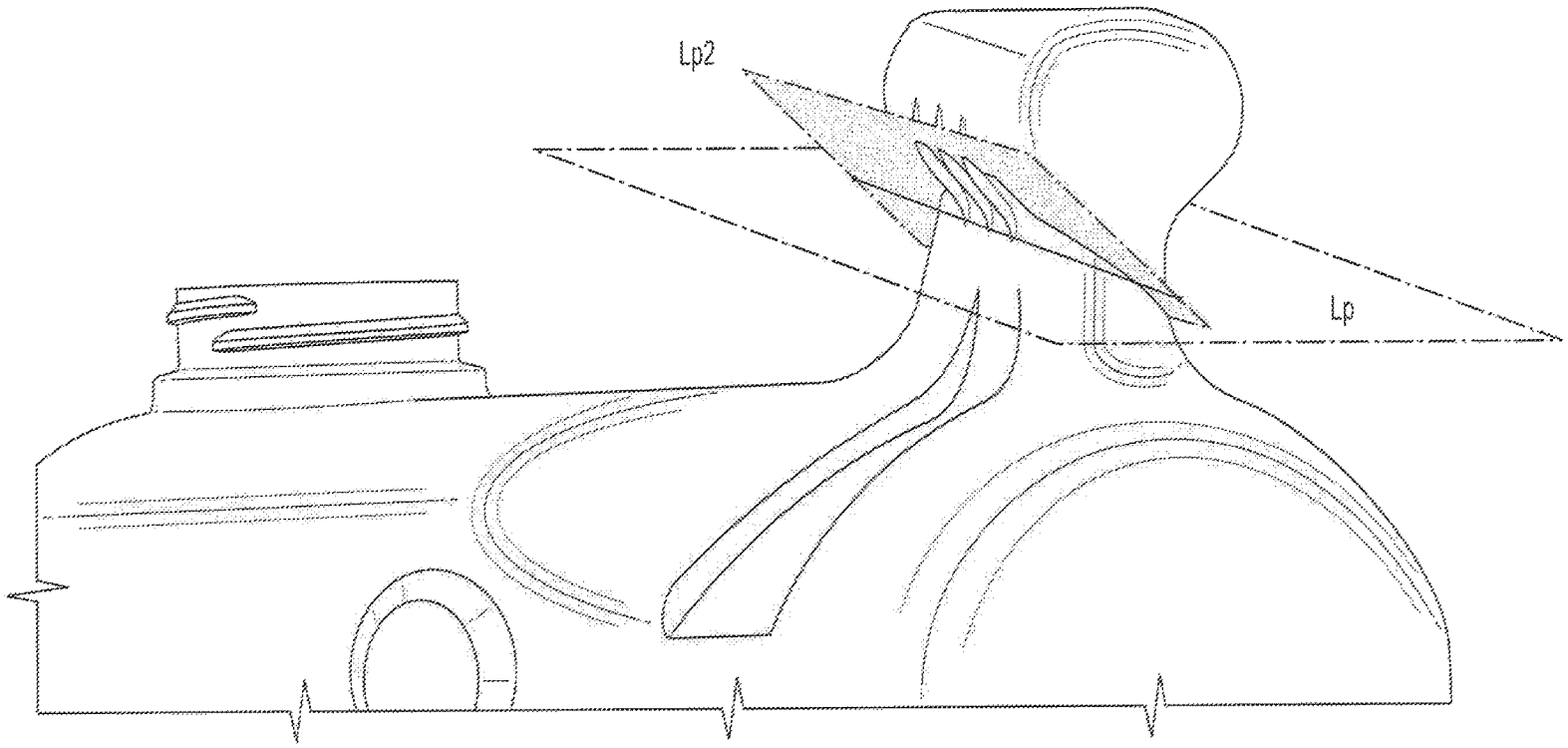

The intersection of lifting plane Lp with two lifting planes Lp1 and Lp2, indicated on FIGS. 31 and 32, consists of two lines, one of which is shown as the CC' axis in FIG. 26. Lifting planes Lp1 and Lp2 define surfaces S3 and S4 of the handle, which are indicated for example on FIGS. 12, 14, 18, 19 and 31. An axis DD' is defined, where DD' and CC' are perpendicular to each other in the front plane view as shown in FIG. 26. In an exemplary embodiment, the angle between the Lp1 plane and the lifting plane Lp, which is effectively slant angle A previously defined and shown in FIG. 1, may be between 20 and 40 degrees. In a preferred embodiment, the angle between the Lp1 plane and the lifting plane Lp may be between 26 and 36 degrees. In another preferred embodiment, the angle between the Lp1 plane and the lifting plane Lp may be between 29 and 33 degrees. In a preferred embodiment, the angle between the Lp1 plane and the lifting plane Lp may be approximately 31 degrees.

In an exemplary embodiment, the angle between the Lp2 plane and the lifting plane Lp, which is effectively angle A previously defined and shown in FIG. 1, may be between 20 and 40 degrees. In a preferred embodiment, the angle between the Lp2 plane and the lifting plane Lp may be between 26 and 36 degrees. In another preferred embodiment, the angle between the Lp2 plane and the lifting plane Lp may be between 29 and 33 degrees. In a preferred embodiment, the angle between the Lp2 plane and the lifting plane Lp may be approximately 31 degrees.

As noted above, one of the benefits of the handle positioning in an exemplary embodiment of the present invention, is the ability to have the lifting force act through the container's center of gravity (CG), thereby eliminating any moment, and associated discomfort. In particular, the angle ($\gamma$) of the lifting plane Lp and its axis CC', as shown in FIG. 26, may contribute to enhanced comfort when carrying the container. In an exemplary embodiment, the value of the geometric angle ($\gamma$) may be varied based on factors such as consumer comfort or packaging considerations related to the overall handle positioning while retaining a lifting force which acts through the container's center of gravity, and the associated benefits noted above.

In an exemplary embodiment of the present invention, the orientation of the handle may depend on at least one of the following parameters: container size, container shape, container contents, which may determine the location of the container's center of gravity, as well as handle location and the angle ($\gamma$) of lifting plane Lp. In an exemplary embodiment, the center of gravity of the filled container may be located based on the container size, shape and contents.

In an exemplary embodiment of the present invention, the angle ($\gamma$) of lifting plane Lp may be the same as the angle between line DD' and a vertical line passing through the CG, representative of the container weight.

In an exemplary embodiment, angle (γ) is the angle between the line (DD') and a line parallel to a vertical of the container in a filling orientation and going through a location of a center of gravity of the filled container, such that when the container is not being lifted an angle between the handle and the direction of the weight force is angle gamma, and when the container is lifted perpendicular to the lifting plane (Lp), line DD' is parallel to the vertical of the container in a filling orientation, and line DD' goes through the location of the center of gravity of the filled container, such that no moment is exerted.

In an exemplary embodiment of the present invention, line DD' may be defined as going through both the center of gravity location, and a point X on lifting plane Lp, as shown in FIG. 26. In an exemplary embodiment of the present invention, X may be located on lifting plane Lp at a distance between 20 and 80% of the distance between handle surfaces S1 and S2, where 0% is at S1 and 100% is at S2. In a preferable exemplary embodiment X may be located on lifting plane Lp at a distance between 30 and 50% of the distance between handle surfaces S1 and S2.

For optimal comfort, in an exemplary embodiment the handle has a stem between 0.5 and 2 inches wide, and a top between 1 and 4 inches wide. In an exemplary embodiment the angle (B) may be referred to as the tilt angle of the handle as measured from the filling orientation's vertical when holding the filled container. In an exemplary embodiment angle (γ) may be identical to angle B. Angle (γ) may be between 10 degrees and 30 degrees. In a preferred embodiment, angle (γ) may be between 15 and 25 degrees, or between 15 and 20 degrees. In yet a more preferred embodiment, angle (γ) may be nominally 18 degrees. In an exemplary embodiment of a filled container, the value chosen for geometric angle (γ) allows the lifting force to pass through the CG location 10, indicated in FIGS. 2 and 26.

In an exemplary embodiment of the present invention, the lifting plane Lp may be perpendicular to line DD'.

In another exemplary embodiment of the present invention, the lifting plane Lp may be at an angle (γ) from a side of the container as defined by line EE in FIG. 26.

Figure 3A:
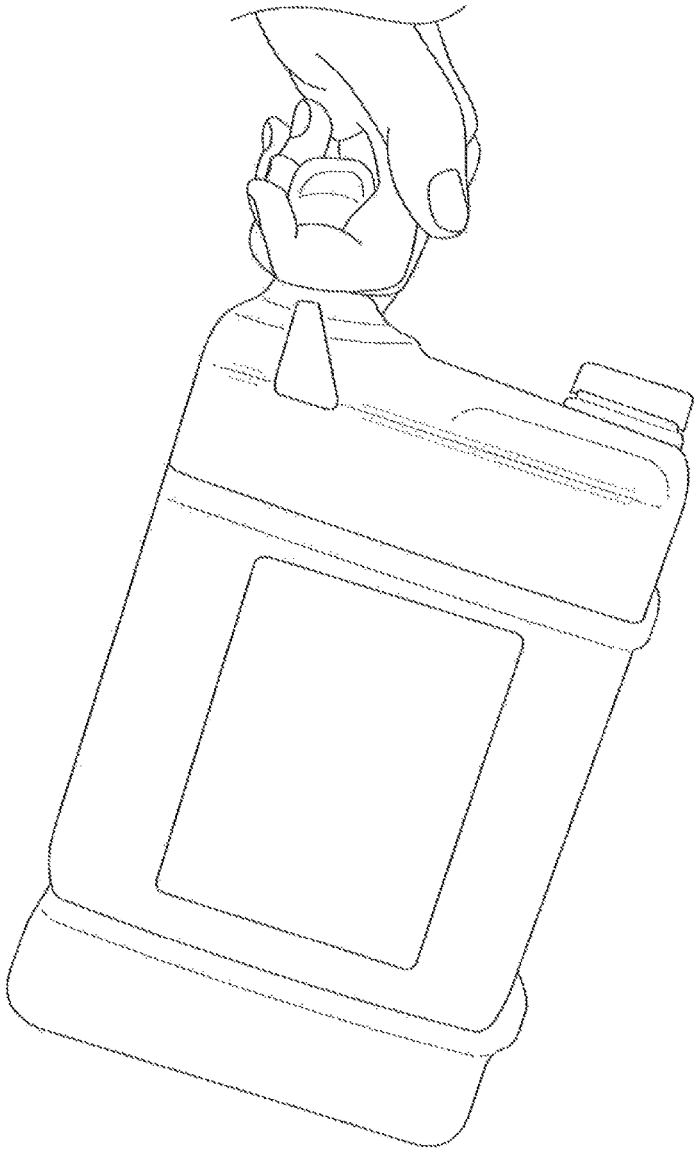
FIG. 3*a* depicts an exemplary container being carried.
Figure 3B:
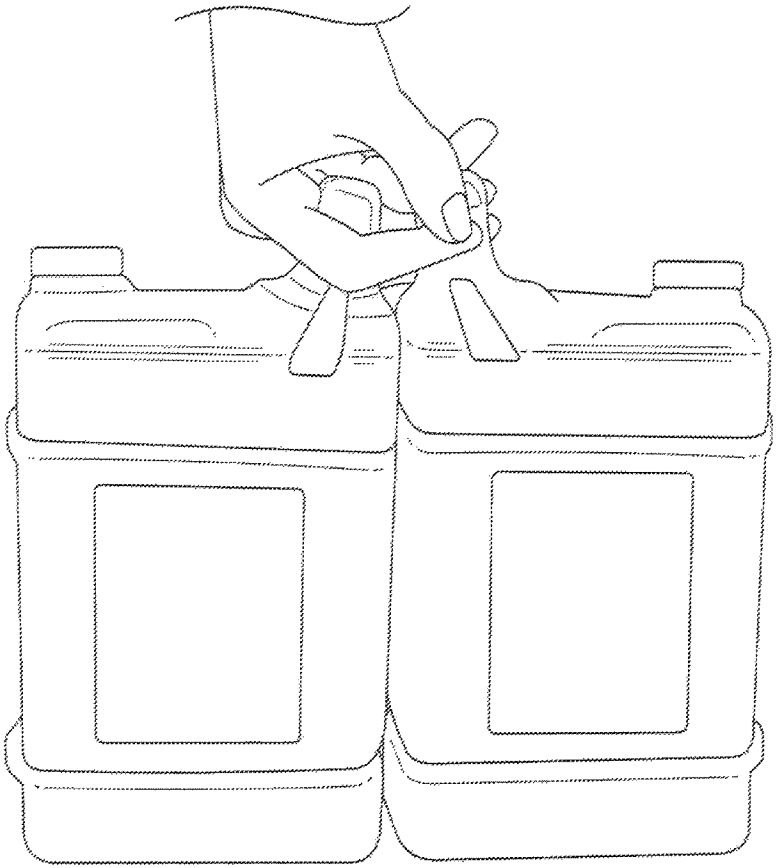
FIG. 3*b* depicts two exemplary containers being carried using only one hand.
Figure 4:
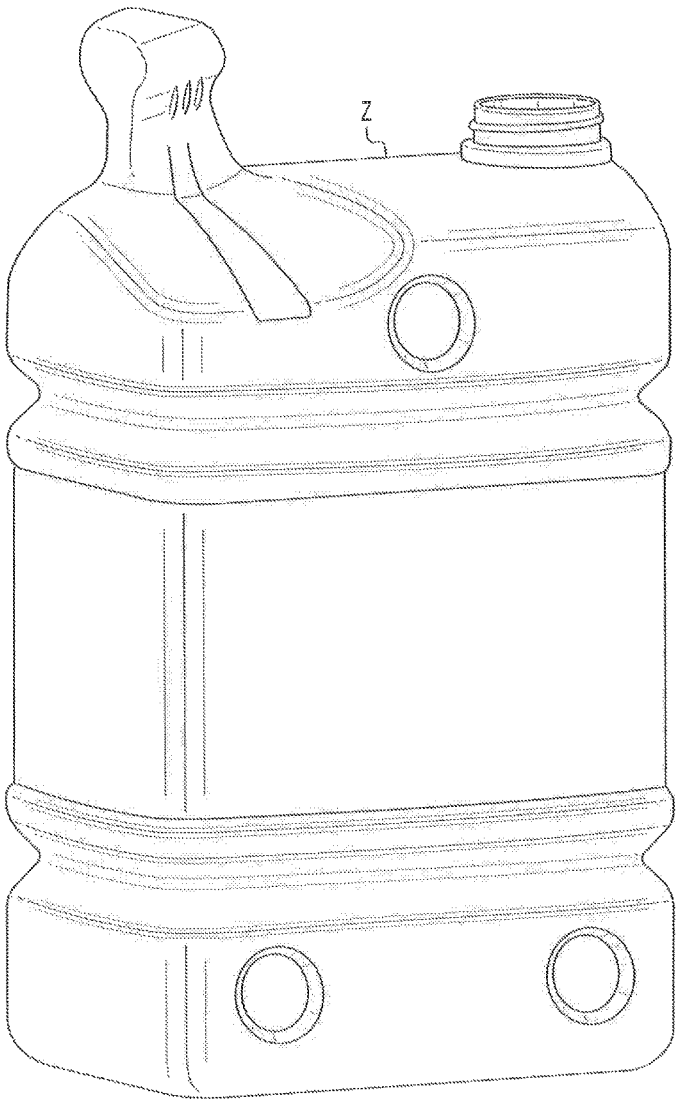
FIG. 4 is a three-dimensional computer rendering of an exemplary container.
Figure 5B:
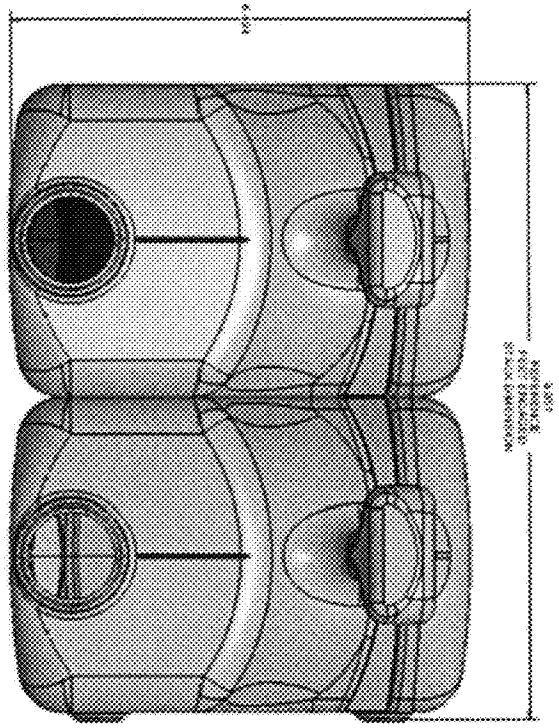
FIG. 5*b* is a front elevational view of two exemplary containers stacked on top of each other.
Figure 5A:
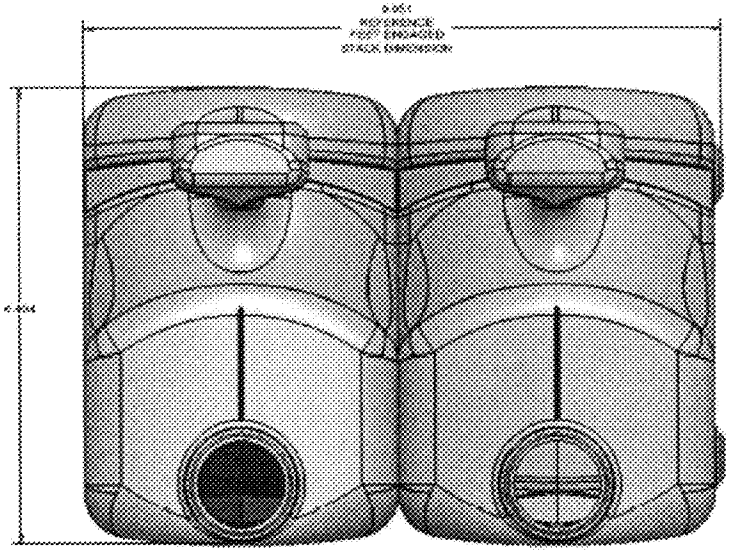
FIG. 5*a* is a front elevational view of two exemplary containers stacked side by side.

In another exemplary embodiment of the present invention, the lifting plane Lp may be a horizontal plane defined as parallel to the ground, when the filled container is being held so that the container orientation is determined by gravity as shown in FIG. 3A.

In an exemplary embodiment of the present invention the container may be loosely held, with fingers positioned against the surfaces S3 and S4 defined by lifting planes Lp1 and Lp2, such that the container may freely rotate about a pivot point, and the lifting plane Lp is parallel to the ground when the container is being loosely held in a stable configuration. In a preferred embodiment, handle surfaces S3 and S4 are provided so that when the container is carried by the handle, the knuckles of the fingers of the hand holding the handle are substantially parallel to the ground as shown in FIG. 3.

In an exemplary embodiment of the present invention, a pivot point when loosely holding the container may be point X. In an exemplary embodiment, the handle of the container may further comprise two undersides such that when the container is carried by the handle, knuckles of a hand holding the handle are substantially parallel to the ground, and fingers of the hand press against the two undersides.

In an exemplary embodiment, the handle stem may be rounded with four radii. In an exemplary embodiment, the handle may be hollow, to allow fluid to be present in the handle.

In an exemplary embodiment, a first flat side of the handle stem, and an opposite second side of the handle stem may be not parallel to each other. In an exemplary embodiment, a first flat side of the handle top, and an opposite second side of the handle top may be not parallel to each other.

In an exemplary embodiment, a slant angle of the handle may be the angle between at least one handle side surface which presses on fingers of a user when the container is held, and a plane parallel to a side of the container from which the handle projects, wherein the slant angle is between 26 and 36 degrees.

In an exemplary embodiment, a geometric angle of the handle may be the angle between a line perpendicular to a reference lifting plane (Lp) parallel to the ground in a lifting orientation and cutting through the handle, and a line parallel to a vertical of the container in a filling orientation, and wherein the geometric angle is between 10 and 30 degrees.

In an exemplary embodiment, a midline of a container side may be between the entire handle and the dispenser. In an exemplary embodiment, the handle may be closer to an end of a side of the container from which the handle projects than to the midline of a container side. In an exemplary embodiment, the base of the handle may be located a distance between 0% and 25% of the length of the container side from which the handle extends.

The invention claimed is:

1. A container for storing and dispensing liquids, comprising:

a dispenser to dispense liquid contained in the container and having a center axis spaced from and arranged on one side of an imaginary vertical plane passing through a center of the container;

a t-shaped handle to carry the container;

the t-shaped handle comprising:

a stem portion;

a top portion whose width is wider than a width of the stem portion;

a top surface of the top portion having a center axis spaced from and arranged on an opposite side of the imaginary vertical plane first and second opposite surfaces that are not parallel to one another; and two undersides having a slant angle (A) of between 20 and 40 degrees in relation to a top surface of the t-shaped handle, wherein the top portion of the t-shaped handle is only connected to the stem portion.

2. The container of claim 1, wherein the first surface is parallel to a sidewall of the container located beneath the t-shaped handle.

3. The container of claim 1, wherein the top portion is located vertically above the stem portion when the container is upright and a container bottom rests on a horizontal surface.

4. The container of claim 1, wherein:

an angle (γ) which is the angle between a line (DD') perpendicular to a reference lifting plane (Lp) parallel to the ground in a lifting orientation and cutting through the handle, and a line parallel to a vertical of the container in a filling orientation of the container; and a tilt angle (B) which is the angle between the line (DD') and a line going through a location of a center of gravity of the container when filled in the direction of a weight force of the container, wherein the lifting plane (Lp) is perpendicular to the weight force of the container when the container is lifted.

5. The container of claim 4, wherein the angle (γ) is between 10 and 30 degrees.

6. The container of claim 1, wherein a line (DD') joins a location of the center of gravity of the container when filled and an axis of rotation (X) on a lifting plane (Lp) of the t-shaped handle.

7. The container of claim 1, wherein the dispenser one of:
has a circular threaded opening; and
is located close to an edge of a face of the container the dispenser is located on.

8. The container of claim 1, further comprising at least one set of protective strap ribs positioned a fixed distance apart.

9. The container of claim 1, wherein the width of the top portion is between 1 and 4 inches, and the width of the stem portion is between 0.5 and 2 inches, and the slant angle (A) of the two undersides is between 26 and 36 degrees.

10. The container of claim 1, wherein an axis of rotation (X) is located on a lifting plane (Lp) at a distance between 20 and 80% of a distance between the first surface and the second surface.

11. The container of claim 1, wherein, when the t-shaped handle is gripped and the container is carried by the t-shaped handle, knuckles of a hand holding the t-shaped handle are substantially parallel to the ground, and fingers of the hand press against the two undersides.

12. The container of claim 1, wherein a lifting plane (Lp) is parallel to the ground when the container is being loosely held about a pivot point in a stable configuration.

13. The container of claim 1, wherein the dispenser is adjacent to a sidewall of the container.

14. The container of claim 1, wherein the t-shaped handle is connected to a container top and is located closer to a sidewall of the container than to a center of the container top.

15. The container of claim 1, wherein one of:
the first surface is parallel to a sidewall of the container; and
the second surface is not parallel to a sidewall of the container.

16. The container of claim 1, wherein the t-shaped handle is hollow and integral with a body of the container.

17. A container for storing and dispensing liquids, comprising:
a container body having a container bottom, a container top and a liquid containing space;
a dispensing opening arranged adjacent one side of container body;
a hollow integrally formed t-shaped handle arranged on the container top and being configured to allow a user to grip and carry the container by gripping the t-shaped handle;
the t-shaped handle arranged adjacent an opposite side of the container body from the dispensing opening and having a upper portion and a stem portion;
the upper portion being sized and configured to fit between the user's fingers and the user's palm;
the stem portion:
being sized and configured to fit between the user's fingers when the upper portion of the t-shaped handle is located between the user's fingers and palm;
connecting the upper portion to the container top; and
being located vertically below the upper portion when the container is upright and resting on a horizontal surface.

18. The container of claim 17, wherein the t-shaped handle further comprises two undersides having a slant angle (A) of between 20 and 40 degrees in relation to a top surface of the t-shaped handle and the top portion of the t-shaped handle is only connected to the stem portion.

19. The container of claim 17, wherein the t-shaped handle further comprises first and second opposite surfaces that are not parallel to one another.

20. A container for storing and dispensing liquids, comprising:
a container body comprising sides with rounded corners, a top, and a bottom;
an off-center container dispensing opening integrally formed with the top;
an off-center hollow container t-shaped handle integrally formed with the top;
the t-shaped handle comprising:
a stem portion;
a top portion whose width is wider than a width of the stem portion;
first and second opposite surfaces that are not parallel to one another; and
two undersides having a slant angle (A) of between 20 and 40 degrees in relation to a top surface of the t-shaped handle,
wherein, when viewed from above the container body, a spacing between a center of the dispensing opening and a center of the top surface is greater than a spacing between a center of the container body and the center of the dispensing opening.

* * * * *